US006312481B1

(12) United States Patent
Lin et al.

(10) Patent No.: US 6,312,481 B1
(45) Date of Patent: Nov. 6, 2001

(54) FUEL COMPOSITIONS

(75) Inventors: Jiang-Jen Lin, Houston, TX (US); James R. Macias, Chester (GB); Sarah Louise Weaver, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 08/947,836

(22) Filed: Oct. 9, 1997

Related U.S. Application Data

(63) Continuation of application No. 08/708,514, filed on Sep. 5, 1996, now abandoned, which is a continuation of application No. 08/310,470, filed on Sep. 22, 1994, now abandoned.

(51) Int. Cl.[7] ..... C10L 1/22

(52) U.S. Cl. ..... 44/418; 44/443; 554/64; 544/168; 564/201; 564/203; 564/204

(58) Field of Search ..... 44/418, 443; 554/64; 544/168; 564/201, 203, 204

(56) References Cited

U.S. PATENT DOCUMENTS

| | | | | |
|---|---|---|---|---|
| 2,559,584 | * | 7/1951 | Barker | 510/535 |
| 3,037,056 | * | 5/1962 | Lowe | 564/208 |
| 3,438,757 | | 4/1969 | Honnen et al. . | |
| 3,574,576 | | 4/1971 | Honnen et al. . | |
| 3,753,670 | | 8/1973 | Strang et al. . | |
| 3,756,793 | | 9/1973 | Robinson . | |
| 4,160,648 | | 7/1979 | Lewis et al. . | |
| 4,191,537 | | 3/1980 | Lewis et al. . | |
| 4,231,759 | | 11/1980 | Udelhofen et al. . | |
| 4,236,020 | | 11/1980 | Lewis et al. . | |
| 4,270,930 | | 6/1981 | Campbell et al. . | |
| 4,288,612 | | 9/1981 | Lewis et al. . | |
| 4,301,083 | * | 11/1981 | Yoshimura et al. | 564/204 |
| 4,525,288 | | 6/1985 | Schlicht . | |
| 4,527,996 | | 7/1985 | Campbell . | |
| 4,612,335 | | 9/1986 | Cuscurida et al. . | |
| 4,747,851 | | 5/1988 | Sung et al. . | |
| 4,810,261 | | 3/1989 | Sung et al. . | |
| 4,832,702 | | 5/1989 | Kummer . | |
| 4,852,993 | | 8/1989 | Sung et al. . | |
| 4,869,728 | | 9/1989 | Sung . | |
| 4,877,416 | | 10/1989 | Campbell . | |
| 4,881,945 | | 11/1989 | Buckley, III . | |
| 4,883,826 | | 11/1989 | Marugg et al. . | |
| 4,936,868 | | 6/1990 | Johnson . | |
| 4,968,321 | | 11/1990 | Sung et al. . | |
| 4,973,414 | | 11/1990 | Nerger et al. . | |
| 4,985,047 | | 1/1991 | Sung et al. . | |
| 5,061,291 | | 10/1991 | Sung . | |
| 5,123,932 | | 6/1992 | Rath et al. . | |
| 5,147,414 | | 9/1992 | Powers, III et al. . | |
| 5,352,251 | | 10/1994 | Lin et al. | 44/340 |
| 5,458,661 | * | 10/1995 | Lin et al. | 44/418 |

FOREIGN PATENT DOCUMENTS 719762 3/1996 (EP) .

OTHER PUBLICATIONS

Int. S/Report dd Jun. 6, 1997.

* cited by examiner

*Primary Examiner*—Margaret Medley
*Assistant Examiner*—Cephia D. Toomer

(57) ABSTRACT

Monoamide-containing polyether alcohol compounds of the formula:

(I)

wherein $R_1$, $R_2$ and $R_3$ are each independently selected from hydrogen, hydrocarbyl of 1 to 100 carbon atoms, substituted hydrocarbyl of 1 to 100 carbon atoms and polyoxyalkylene alcohol of 2 to 200 carbon atoms or $R_2$ and $R_3$ taken together form a heterocyclic group of 2 to 100 carbon atoms or a substituted heterocyclic group of 2 to 100 carbon atoms with the proviso that at least one of $R_1$, $R_2$ or $R_3$ must be polyoxyalkylene alcohol have been found to decrease intake valve deposits, control octane requirement increases and reduce octane requirement when used as gasoline additives.

110 Claims, No Drawings

FUEL COMPOSITIONS

This is a continuation of application Ser. No. 08/708,514, filed Sep. 5, 1996 now abandoned which is a continuation of application Ser. No. 08/310,470, filed Sep. 22, 1994 now abandoned.

BACKGROUND OF THE INVENTION

1. Field of the Invention

The present invention relates to the use of monoamide-containing polyether alcohol compounds as additives in fuel compositions and the use of these compounds to decrease intake valve deposits, control octane requirement increase, and reduce octane requirement. The present invention further relates to a class of monoamide-containing polyether alcohol compounds.

2. Background

The octane requirement increase effect exhibited by internal combustion engines, e.g., spark ignition engines, is well known in the art. This effect may be described as the tendency for an initially new or relatively clean engine to require higher octane quality fuel as operating time accumulates, and is coincidental with the formation of deposits in the region of the combustion chamber of the engine.

During the initial operation of a new or clean engine, a gradual increase in octane requirement, i.e., fuel octane number required for knock-free operation, is observed with an increasing build up of combustion chamber deposits until a stable or equilibrium octane requirement level is reached. This level appears to correspond to a point in time when the quantity of deposit accumulation on the combustion chamber and valve surfaces no longer increases but remains relatively constant. This so-called "equilibrium value" is normally reached between 3,000 and 20,000 miles or corresponding hours of operation. The actual equilibrium value of this increase can vary with engine design and even with individual engines of the same design; however, in almost all cases, the increase appears to be significant, with octane requirement increase values ranging from about 2 to about 10 research octane numbers being commonly observed in modern engines.

The accumulation of deposits on the intake valves of internal combustion engines also presents problems. The accumulation of such deposits is characterized by overall poor driveability including hard starting, stalls, and stumbles during acceleration and rough engine idle.

Many additives are known which can be added to hydrocarbon fuels to prevent or reduce deposit formation, or remove or modify formed deposits, in the combustion chamber and on adjacent surfaces such as intake valves, ports, and spark plugs, which in turn causes a decrease in octane requirement.

Continued improvements in the design of internal combustion engines, e.g., fuel injection and carburetor engines, bring changes to the environment of such engines thereby creating a continuing need for new additives to control the problem of inlet system deposits and to improve driveability which can be related to deposits.

It would be an advantage to have fuel compositions which would reduce the formation of deposits and modify existing deposits that are related to octane requirement increase and poor driveability in modern engines which burn hydrocarbon fuels.

SUMMARY OF THE INVENTION

The present invention is directed to the use of monoamide-containing polyether alcohol compounds as additives in fuel compositions comprising a major amount of a mixture of hydrocarbons in the gasoline boiling range and a minor amount of one or more monoamide-containing polyether alcohol compounds of the formula:

(I)

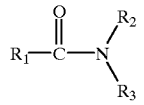

wherein $R_1$, $R_2$ and $R_3$ are each independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms or $R_2$ and $R_3$ taken together form a heterocyclic group of 2 to 100 carbon atoms or a substituted heterocyclic group of 2 to 100 carbon atoms and the weight average molecular weight of the additive compound is greater than about 600 with the proviso that at least one of $R_1$, $R_2$ or $R_3$ must be polyoxyalkylene alcohol.

The invention is also directed to the use of these monoamide-containing polyether alcohol compounds for decreasing intake valve deposits, controlling octane requirement increases and reducing octane requirement. The present invention is further directed to a class of monoamide-containing polyether alcohol compounds.

DESCRIPTION OF THE PREFERRED EMBODIMENTS COMPOUNDS

The compounds of the present invention, broadly expressed as monoamide-containing alkoxylates, are a new class of additives useful for hydrocarbon fuels, e.g., fuels in the gasoline boiling range, for preventing deposits in engines, controlling octane requirement increases and reducing octane requirement, while also decomposing during combustion to environmentally acceptable products. The compounds produce very little residue and are miscible with carriers and other detergents. Non-limiting illustrative embodiments of the compounds useful as additives in the instant invention include those of Formula I:

(I)

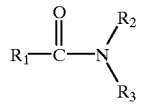

In Formula I, $R_1$, $R_2$ and $R_3$ are each independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms or $R_2$ and $R_3$ taken together form a heterocyclic group of 2 to 100 carbon atoms or a substituted heterocyclic group of 2 to 100 carbon atoms with the proviso that at least one of $R_1$, $R_2$ and $R_3$ must be polyoxyalkylene alcohol. When one or more of $R_1$, $R_2$ or $R_3$ are polyoxyalkylene alcohol, they are preferably independently selected from polyoxyalkylene alcohol of Formula II:

(II)

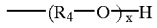

wherein x is from 1 to 50 and each $R_4$ is independently selected from the group consisting of hydrocarbyl of 2 to 100 carbon atoms and substituted hydrocarbyl of 2 to 100 carbon atoms.

As used herein, the term "hydrocarbyl" represents a radical formed by the removal of one or more hydrogen atoms from a carbon atom of a hydrocarbon (not necessarily the same carbon atom). Useful hydrocarbyls are aliphatic, aromatic, substituted, unsubstituted, acyclic or cyclic. Preferably, the hydrocarbyls are aryl, alkyl, alkenyl or cycloalkyl and are straight-chain or branched-chain. Representative hydrocarbyls include methyl, ethyl, butyl, pentyl, methylpentyl, hexenyl, ethylhexyl, dimethylhexyl, octamethylene, octenylene, cyclooctylene, methylcyclooctylene, dimethylcyclooctyl, isooctyl, dodecyl, hexadecenyl, octyl, eicosyl, hexacosyl, triacontyl and phenylethyl. As noted, the hydrocarbyls utilized may be substituted. As used herein the term "substituted hydrocarbyl" refers to any "hydrocarbyls" which contain a functional group such as carbonyl, carboxyl, nitro, amino, hydroxy (e.g. hydroxyethyl), oxy, cyano, sulfonyl, and sulfoxyl. The majority of the atoms, other than hydrogen, in substituted hydrocarbyls are carbon, with the heteroatoms (i.e., oxygen, nitrogen, sulfur) representing only a minority, 33% or less, of the total non-hydrogen atoms present.

When either $R_1$, $R_2$ or $R_3$ are hydrocarbyl or substituted hydrocarbyl they will preferably be hydrocarbyl or substituted hydrocarbyl of 1 to 50 carbon atoms, more preferably hydrocarbyl or substituted hydrocarbyl of 1 to 20 carbon atoms. Particularily preferred embodiments of the present invention are those in which when either $R_1$, $R_2$ or $R_3$ are hydrocarbyl, they are independently selected from alkyl of 1 to 20 carbon atoms and cycloalkyl of 4 to 20 carbon atoms, preferably alkyl of 1 to 10 carbon atoms and cycloalkyl of 4 to 10 carbon atoms. When either $R_1$, $R_2$ or $R_3$ are hydrocarbyl of a relatively high number of carbon atoms, i.e., greater than about 50 carbon atoms, each will be represented by polymeric hydrocarbyls derived from polyisobutylene, polybutene, polypropylene or polyalpha olefin.

In addition, $R_2$ and $R_3$ taken together with the nitrogen atom to which they are connected can form a heterocyclic group of 4 to 100 carbon atoms or a substituted heterocyclic group which contains 4 to 100 carbon atoms. Preferably $R_2$ and $R_3$ taken together form a heterocyclic group which contains 4 to 50 carbon atoms and even more preferably of 4 to 20 carbon atoms.

As used herein, the term "heterocyclic group" refers to any cyclic group comprising both a nitrogen atom and carbon atoms which may result from $R_2$ and $R_3$ being taken together with the nitrogen atom to which they are connected form a ring or also to when $R_2$ and $R_3$ taken together with the nitrogen atom to which they are connected form bicyclic rings or multiple, fused rings. The heterocyclic groups may be substituted or unsubstituted. In addition, the heterocyclic group may include branched substituents such as straight or branch chained alkyls. The term "substituted heterocyclic group" refers to any "heterocyclic group" which contains a functional group such as carbonyl, carboxyl, nitro, amino, hydroxy, oxy, cyano, sulfonyl, and sulfoxyl.

In the preferred embodiment, $R_2$ and $R_3$ taken together with the nitrogen to which they are connected form a heterocycloalkyl with a 5–6 member ring (4–5 carbon atoms) or a substituted heterocycloalkyl with a 5–6 member ring (having 4–5 carbon atoms in the ring and from 5 to 20 total carbon atoms), with morpholine being the most preferred heterocycloalkyl and 4-methyl-morpholine being the most preferred substituted heterocycloalkyl.

As noted previously, at least one of $R_1$, $R_2$ and $R_3$ must be polyoxyalkylene alcohol of 2 to 200 carbon atoms. When $R_1$, $R_2$ and/or $R_3$ are polyoxyalkylene alcohol of 2 to 200 carbon atoms, they are each independently selected from polyoxyalkylene alcohol of Formula II:

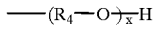

(II)

wherein x is from 1 to 50 and each $R_4$ is independently selected from the group consisting of hydrocarbyl, as defined hereinbefore, of 2 to 100 carbon atoms and substituted hydrocarbyl, as defined hereinbefore, of 2 to 100 carbon atoms. When $R_4$ is hydrocarbyl of a relatively high number of carbon atoms, i.e., greater than about 50 carbon atoms, each will be represented by polymeric hydrocarbyls derived from polyisobutylene, polybutene, polypropylene or polyalpha olefin.

Preferably, each $R_4$ is independently selected from hydrocarbyl of 2 to 50 carbon atoms and substituted hydrocarbyl of 2 to 50 carbon atoms. More preferably, each $R_4$ is independently selected from hydrocarbyl of 2 to 20 carbon atoms and substituted hydrocarbyl of 2 to 20 carbon atoms, more preferably alkyl of 2 to 4 carbon atoms and oxy-substituted substituted hydrocarbyl of 2 to 20 carbon atoms.

Particularly preferred compounds of Formula I are those in which the $R_4$ of the polyoxyalkylene alcohol is hydrocarbyl (geminal or vicinal) of formula:

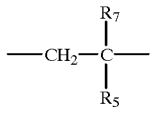

(III)

or

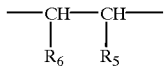

(IV)

wherein each $R_5$, $R_6$ and $R_7$ is independently selected from the group consisting of hydrogen, hydrocarbyl, as defined hereinbefore, of 1 to 98 carbon atoms and substituted hydrocarbyl, as defined hereinbefore, of 1 to 98 carbon atoms. Preferred $R_5$, $R_6$ and $R_7$ groups are those independently selected from hydrogen, hydrocarbyl of 1 to 18 carbon atoms and substituted hydrocarbyl of 1 to 18 carbon atoms. In addition, $R_5$ and $R_6$, or alternatively $R_5$ and $R_7$, may be taken together to form a divalent linking hydrocarbyl group of 3 to 12 carbon atoms. When $R_5$, $R_6$ and/or $R_7$ are substituted hydrocarbyl, the are preferably oxy-substituted hydrocarbyl.

The most preferred compounds of Formula I are those in which each $R_4$ of the polyoxyalkylene alcohol is hydrocarbyl or substituted hydrocarbyl as represented by Formula III above wherein each $R_7$ is hydrogen and each $R_5$ is independently selected from hydrogen, alkyl of 1 to 18 carbon atoms and oxy-substituted hydrocarbyl of 1 to 18 carbon atoms, particularly those compounds where each $R_7$ is hydrogen and each $R_5$ is independently selected from hydrogen, alkyl of 1 to 2 carbon atoms and oxy-substituted hydrocarbyl of the formula:

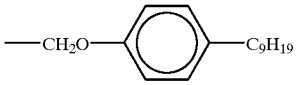

and especially those compounds where each $R_7$ is hydrogen and each $R_5$ is independently selected from hydrogen and alkyl of 2 carbon atoms.

When $R_5$ is oxy-substituted hydrocarbyl of 1 to 18 carbon atoms, $R_5$ is preferably an alkoxy-substituted alkylene of 1 to 18 carbon atoms or an aryloxy-substituted alkylene of 1 to 18 carbon atoms. Particularly preferred alkoxy-substituted alkylene groups include ethylhexyleneoxymethylene, isopropoxymethylene, butoxymethylene and mixtures thereof. Particularly preferred aryl-substituted alkylene groups include nonylphenoxymethylene, phenoxymethylene and mixtures thereof.

In Formula II above, x is from 1 to 50, preferably from 1 to 40, and even more preferably from 1 to 26. Those of ordinary skill in the art will recognize that when the polyoxyalkylene alcohols of Formula II are used in compounds of Formula I, x will not have a fixed value but will instead be represented by a range of different values. As used in this specification, x is considered to be a (number) average of the various values of x that are found in a given composition, which number has been rounded to the nearest integer. The range of x is indicated in the various examples by the polydispersity (polydispersity=molecular weight based on the weight average divided by the molecular weight based on the number average).

When x is greater than 1, the individual $R_4$'s may be the same or different. For example, if x is 20, each $R_4$ can be alkyl of four carbon atoms. Alternatively, the $R_4$'s can differ and for instance, independently be alkyl from two to four carbon atoms. When the $R_4$'s differ, they may be present in blocks, i.e., all x groups in which $R_4$ is alkyl of three carbon atoms will be adjacent, followed by all x groups in which $R_4$ is alkyl of two carbon atoms, followed by all x groups in which $R_4$ is alkyl of four carbon atoms. When the $R_4$'s differ, they may also be present in any random distribution.

In one preferred embodiment, $R_1$, $R_2$ and $R_3$ are all polyoxyalkylene alcohol of Formula II. When $R_1$, $R_2$ and $R_3$ are polyoxyalkylene alcohol of Formula II, preferably the sum of the values of all 3 x's will not exceed 40, more preferably, the sum of the values of all 3 x's will not exceed 26. When $R_1$, $R_2$ and $R_3$ are each polyoxyalkylene alcohol of Formula II, each x will preferably be from 1 to 8.

In an alternative preferred embodiment, two of the group $R_1$, $R_2$ and $R_3$ are polyoxyalkylene alcohol of Formula II with $R_2$ and $R_3$ being the more preferred two of the group. When two of the group $R_1$, $R_2$ and $R_3$ are each polyoxyalkylene alcohol of Formula II, preferably the sum of the values of both x's will not exceed 40, even more preferably, the sum of the values of both x's will not exceed 26. In the preferred embodiment where two of the group $R_1$, $R_2$ and $R_3$ are polyoxyalkylene alcohol of Formula II, each x will preferably be from 1 to 13 and the remaining R group will preferably be selected from alkyl of 1 to 20 carbon atoms and oxy-substituted hydrocarbyl of 1 to 20 carbon atoms.

In a third preferred embodiment of the present invention, either $R_1$, $R_2$ or $R_3$ are polyoxyalkylene alcohol of Formula II. When one of the group $R_1$, $R_2$ and $R_3$ is polyoxyalkylene alcohol of Formula II, preferably the value of x will range from 8 to 26.

In another preferred embodiment of the present invention, when $R_4$ of the polyoxyalkylene alcohol of Formula II is of Formula III, $R_7$ will be hydrogen and each $R_5$ will be independently selected from hydrogen, alkyl of 1 to 2 carbon atoms and oxy-substituted hydrocarbyl of the formula:

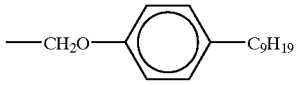

When one of the group $R_1$, $R_2$ and $R_3$ is polyoxyalkylene alcohol of Formula II and the value of x ranges from 8 to 26, preferably $R_5$ will be oxy-substituted hydrocarbyl of the above formula in 1 to 4 of the x groups and in the remaining x groups (4–25 groups) each $R_5$ will be independently selected from hydrogen and alkyl of 1 to 2 carbon atoms. When two of the group $R_1$, $R_2$ and $R_3$ are polyoxyalkylene alcohol of Formula II and the value of each x ranges from 1 to 13, preferably with regard to each group of $R_1$, $R_2$ and $R_3$ which is polyoxyalkylene alcohol of Formula II, $R_5$ will be oxy-substituted hydrocarbyl of the above formula in 1 to 2 of the x groups and in the remaining x groups (up to 12 groups) each $R_5$ will be independently selected from hydrogen and alkyl of 1 to 2 carbon atoms. When all three of the group $R_1$, $R_2$ and $R_3$ are polyoxyalkylene alcohol of Formula II and the value of each x ranges from 1 to 8, preferably with regard to each group of $R_1$, $R_2$ and $R_3$, $R_5$ will be oxy-substituted hydrocarbyl of the above formula in 1 to 2 of the x groups and in the remaining x groups (up to 7 groups) each $R_5$ will be independently selected from hydrogen and alkyl of 1 to 2 carbon atoms.

The present invention is also directed to compounds of Formula I wherein $R_1$, $R_2$ and $R_3$ are as defined hereinbefore.

The compounds of Formula I have a weight average molecular weight of at least 600. Preferably, the weight average molecular weight is from about 800 to about 4000, even more preferably from about 800 to about 2000.

Typical compounds represented by Formula I include those listed by structure in Table 1.

TABLE 1

| Example # | Compound |
|---|---|
| 1 | 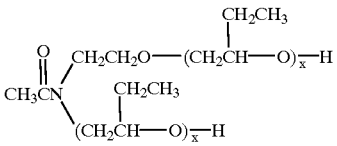 wherein each x is from 1 to 13. |

TABLE 1-continued
| Example # | Compound |
|---|---|
| 15 | 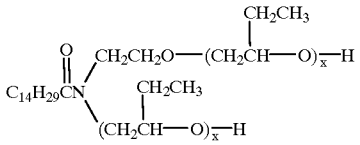 wherein each x is from 1 to 13. |
| 28 | 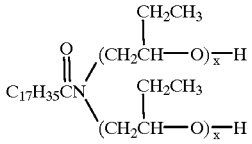 wherein each x is from 1 to 13. |
| 17 | 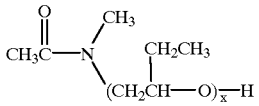 wherein x is from 8 to 26. |
| 12 | 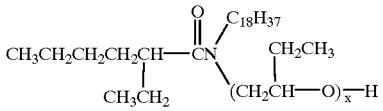 wherein x is from 8 to 26. |
| 14 | 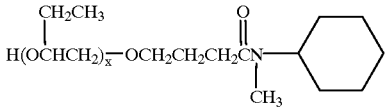 wherein x is from 8 to 26. |
| 18 | 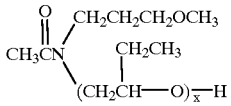 wherein x is from 8 to 26. |
| 24 | 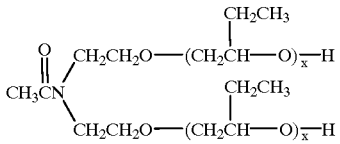 wherein each x is from 1 to 13. |
| 9 | 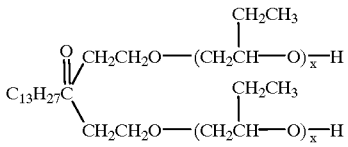 wherein each x is from 1 to 13. |
| 21 | 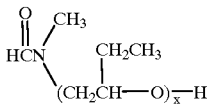 wherein x is from 8 to 26. |

TABLE 1-continued
| Example # | Compound |
|---|---|
| 11 | 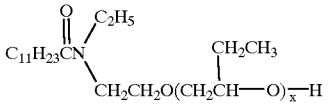 wherein x is from 8 to 26. |
| 13 | 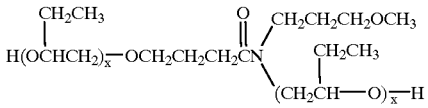 wherein x is from 1 to 13. |
| 27 | 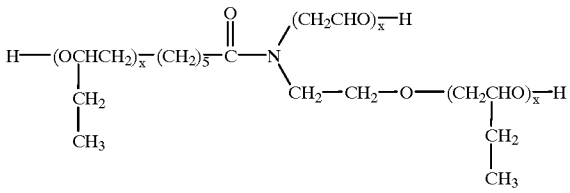 wherein each x is from 1 to 8. |
| 19 | 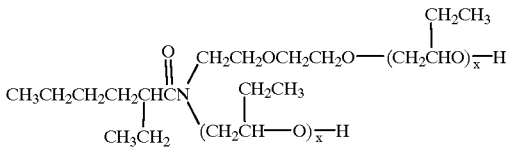 wherein each x is from 1 to 13. |
| 25 | 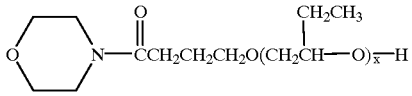 wherein x is from 8 to 26. |
| 26 | 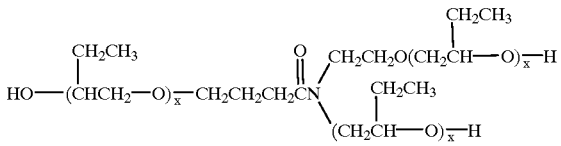 wherein the sum of all three x's does not exceed 26. |
| 3 | 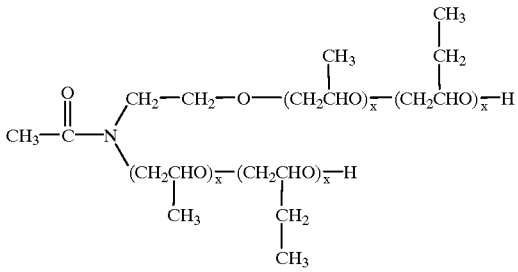 wherein each x is from 1 to 13. |
| 4 | 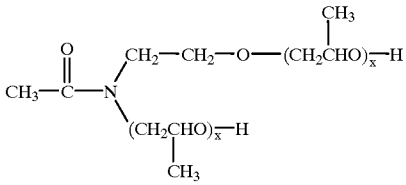 wherein each x is from 1 to 26. |

TABLE 1-continued
| Example # | Compound |
|---|---|
| 5 | 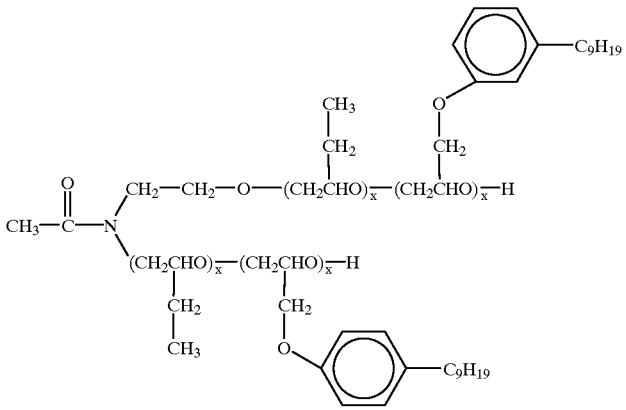 wherein the sum of all x's does not exceed 26. |
| 8 | 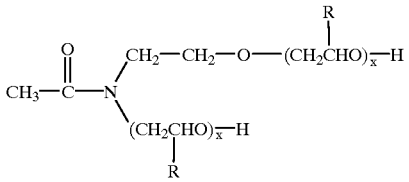 wherein each R is alkyl of 2 to 10 carbon atoms and each x is from 1 to 13. |
| 10 | 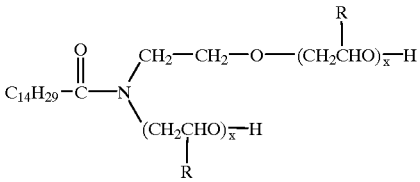 wherein each R is $-C_2H_5$ or 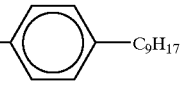 and each x is from 1 to 26. |
| 16 | 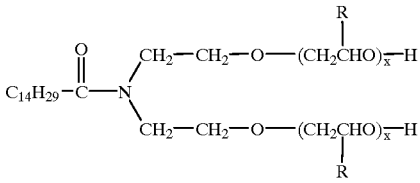 wherein each R is $-C_2H_5$ or 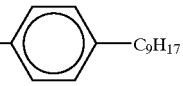 and each x is from 1 to 26. |
| 20 | 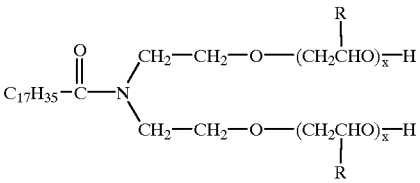 wherein each R is $-C_2H_5$ and each x is from 1 to 26. |

TABLE 1-continued

| Example # | Compound |
|---|---|
| 22 | 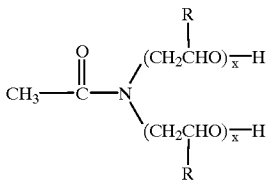 wherein each R is $-C_2H_5$ and each x is from 1 to 26. |
| 23 | 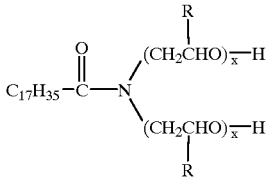 wherein each R is $-C_2H_5$ and x is from 1 to 26. |
| 6 | 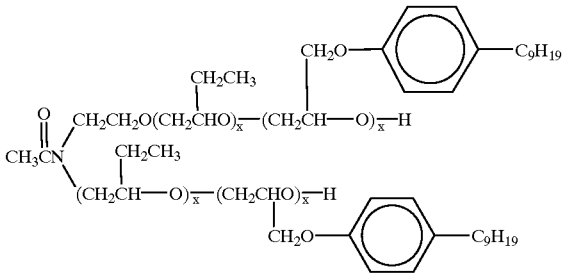 wherein the sum of all x's does not exceed 26. |

The compounds of Formula I are illustratively prepared by alkoxylation, i.e., reacting an initiator selected from amides and amidoalcohols with epoxides in the presence of a potassium compound.

In one embodiment, the compounds of Formula I are prepared utilizing initiators represented by the general formula:

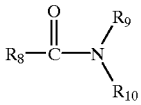

(V)

wherein $R_8$, $R_9$ and $R_{10}$ are each independently selected from the group consisting of hydrogen, hydrocarbyl of 1 to 100 carbon atoms, substituted hydrocarbyl of 1 to 100 carbon atoms and hydroxyalkyls of 2 to 100 carbon atoms with the proviso that at least one of $R_8$, $R_9$ and $R_{10}$ must be hydrogen or hydroxyalkyl of 2 to 100 carbon atoms. Preferably $R_8$, $R_9$ and $R_{10}$ are independently selected from the group consisting of hydrogen, hydrocarbyl of 1 to 50 carbon atoms, substituted hydrocarbyl of 1 to 50 carbon atoms and hydroxyalkyls of 2 to 50 carbon atoms. Even more preferably, they are selected from hydrogen, hydrocarbyl of 1 to 20 carbon atoms, substituted hydrocarbyl of 1 to 20 carbon atoms and hydroxyalkyls of 2 to 20 carbon atoms.

Non-limiting examples of initiators which are employed include amides such as N-acetylmonoethanolamine, N-methylacetamide, N-acetyl methoxypropylamide, N-methyl formamide and acetamide and amidoalcohols such as coconut amide of monoethanolamine and coconut diethanolamide, with amidoalcohols being the most preferred. Select initiators are available commercially, including, but not limited to, acetamide, 4-acetamidophenol, acetanilide, 1-acetamidopyrene, 6-acetamidohexanoic acid, 4-acetamido-9-fluorenone, 2-acetamidofluorene, N-acetylethanolamine, N-acetylethylenediamine, N-acetyl-D-galactosamine, N-acetyl-L-glutamic acid, N-acetylglycinamide, DL-N-acetylhomocysteine thiolactone, adipamide, N-acetyl-L-lysine, acrylamide, 4-aminobenzamide, 6-aminonicotinamide, anthranilamide, L-asparagine, 2-azacyclooctanone, azodicarbonamide, benzamide, benzanilide, N-benzylformamide, N,N-Bis(2-hydroxyethyl)formamide, 4-bromobenzamide, 2-,3-, or 4-ethoxybenzamide, ethyl acetamidoacetate, salicylamide, oxamide, phthalimide, succinamide, 2-, 3-, or 4-nitrobenzamide, octadecanamide, N-(2-hydroxyethyl) salicylamide, isobutyramide, lactamide, malonamide, methacrylamide, propionamide, O-toluamide, m-toluamide, p-toluamide, 2,2,-trifluoroacetamide, valerolactam, stearamide (Kenamide® S Fatty Amide, from Witco Chemical Company), stearyl erucamide (Kenamide® E-180 Fatty Amide, from Witco Chemical Company), Kenamide® W-40 Fatty Bisamide (from Witco Chemical Company), Eurcamide (Kenamide® E, from Witco Chemical Company), Erucyl erucamide (Kenamide® E-221, from Witco Chemical Company), Oleyl palmitamide (Kenamide® P-181, from Witco Chemical Company), stearyl stearamide (Kenamide® S-180, from Witco Chemical Company), erucyl stearamide (Kenamide® S-221, from Witco Chemical Company), oleic diethanolamide (or N,N-bis(2-hydroxyethyl) octadecenamide-9, EMID® 6545, Henkel Corporation), EMID® 6515 (N,N-bis(hydroxyethyl) coconut amide, Fatty alkanolamide, from Henkel Corporation), and EMID® 6500 (Fatty alkanolamide or cocoamide MEA, from Henkel Corporation). The most preferred commercially available initiator is N-acetylmonoethanolamine. In addition, the initiators may be prepared by any of the methods known and described in the art, for example by reacting an amine with a carboxylic acid or ester to form an amide.

The one or more epoxides employed in the reaction with the initiators to prepare the compounds of Formula I contain from 2 to 100 carbon atoms, preferably from 2 to 50 carbon atoms, more preferably from 2 to 20 carbon atoms, most preferably from 2 to 4 carbon atoms. The epoxides may be internal epoxides such as 2,3 epoxides of the formula:

(VI)

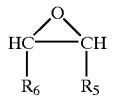

wherein $R_5$ and $R_6$ have the above meanings or terminal epoxides such as 1,2 epoxides of the formula:

(VII)

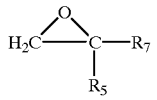

wherein $R_5$ and $R_7$ have the above meanings. In both Formulas VI and VII, $R_6$ and $R_5$, or alternatively $R_5$ and $R_7$, may be taken together to form a cycloalkylene epoxide or a vinylidene epoxide by forming a divalent linking hydrocarbyl group of 3 to 12 carbon atoms.

When $R_5$, $R_6$ and/or $R_7$ are oxy-substituted hydrocarbyl, suitable compounds of Formulas VI and VII will include compounds such as nonylphenyl glycidyl ether, phenyl glycidyl ether, cresyl glycidyl ether, butyl glycidyl ether, alkyl $C_{12}$–$C_{13}$ glycidyl ether, alkyl $C_8$–$C_{10}$ glycidyl ether, 2-ethylhexyl glycidyl ether and isopropyl glycidyl ether.

In the preferred embodiment, the terminal epoxides represented by Formula VII are utilized. Ideally these terminal epoxides are 1,2-epoxyalkanes. Suitable 1,2-epoxyalkanes include 1,2-epoxyethane, 1,2-epoxypropane, 1,2-epoxybutane, 1,2-epoxydecane, 1,2-epoxydodecane, 1,2-epoxyhexadecane, 1,2-epoxyoctadecane and mixtures thereof.

In a typical preparation of Formula I compounds, the one or more epoxides and initiator are contacted at a ratio from about 7:1 to about 55:1 moles of epoxide per mole of initiator. Preferably, they are contacted at a molar ratio from about 10:1 to about 30:1, with the most preferred molar ratio being about 20:1.

The reaction is carried out in the presence of potassium compounds which act as alkoxylation catalysts. Such catalysts are conventional and include potassium methoxide, potassium ethoxide, potassium hydroxide, potassium hydride and potassium-t-butoxide. The preferred catalysts are potassium hydroxide and potassium-t-butoxide. The catalysts are used in a base stable solvent such as alcohol, ether or hydrocarbons. The catalysts are employed in a wide variety of concentrations. Generally, the potassium compounds will be used in an amount from about 0.02% to about 5.0% of the total weight of the mixture, preferably from about 0.1% to about 2.0% of the total weight of the mixture, and most preferably about 0.2% of the total weight of the mixture.

The reaction is conveniently carried out in a conventional autoclave reactor equipped with heating and cooling means. The process is practiced batchwise, continuously or semi-continuously.

The manner in which the alkoxylation reaction is conducted is not critical to the invention. Illustratively, the initiator and potassium compound are mixed and heated under vacuum for a period of at least 30 minutes. The one or more epoxides are then added to the resulting mixture, the reactor sealed and pressurized with nitrogen, and the mixture stirred while the temperature is gradually increased.

The temperature for alkoxylation is from about 80° C. to about 180° C., preferably from about 100° C. to about 150° C., and even more preferably from about 120° C. to about 140° C. The alkoxylation reaction time is generally from about 2 to about 20 hours, although longer or shorter times can be employed.

Alkoxylation processes of the above type are known and are described, for example in U.S. Pat. No. 4,973,414, U.S. Pat. No. 4,883,826, U.S. Pat. No. 5,123,932 and U.S. Pat. No. 4,612,335, each incorporated herein by reference.

The product of Formula I is normally liquid and is recovered by conventional techniques such as filtration and distillation. The product is used in its crude state or is purified, if desired, by conventional techniques such as aqueous extraction, solid absorption and/or vacuum distillation to remove any remaining impurities.

Other methods for making the compounds of Formula I are known by those skilled in the art. For example, the compounds of Formula I are prepared by reacting a carboxylic ester with an aminoalcohol or amine. In addition, other catalyst chemistry, such as the use of acidic catalysts, can be employed to achieve the compounds of Formula I.

Fuel Compositions

The compounds of Formula I are useful as additives in fuel compositions which are burned or combusted in internal combustion engines. The fuel compositions of the present invention comprise a major amount of a mixture of hydrocarbons in the gasoline boiling range and a minor amount of one or more of the compounds of Formula I. As used herein, the term "minor amount" means less than about 10% by weight of the total fuel composition, preferably less than about 1% by weight of the total fuel composition and more preferably less than about 0.1% by weight of the total fuel composition.

Suitable liquid hydrocarbon fuels of the gasoline boiling range are mixtures of hydrocarbons having a boiling range of from about 25° C. to about 232° C., and comprise mixtures of saturated hydrocarbons, olefinic hydrocarbons and aromatic hydrocarbons. Preferred are gasoline mixtures having a saturated hydrocarbon content ranging from about 40% to about 80% by volume, an olefinic hydrocarbon content from 0% to about 30% by volume and an aromatic hydrocarbon content from about 10% to about 60% by volume. The base fuel is derived from straight run gasoline, polymer gasoline, natural gasoline, dimer and trimerized olefins, synthetically produced aromatic hydrocarbon mixtures, or from catalytically cracked or thermally cracked petroleum stocks, and mixtures of these. The hydrocarbon composition and octane level of the base fuel are not critical. The octane level, (R+M)/2, will generally be above about 85.

Any conventional motor fuel base can be employed in the practice of the present invention. For example, hydrocarbons in the gasoline can be replaced by up to a substantial amount of conventional alcohols or ethers, conventionally known for use in fuels. The base fuels are desirably substantially free of water since water could impede a smooth combustion.

Normally, the hydrocarbon fuel mixtures to which the invention is applied are substantially lead-free, but may contain minor amounts of blending agents such as methanol, ethanol, ethyl tertiary butyl ether, methyl tertiary butyl ether, and the like, at from about 0.1% by volume to about 15% by volume of the base fuel, although larger amounts may be utilized. The fuels can also contain conventional additives including antioxidants such as phenolics, e.g., 2,6-di-tert-butylphenol or phenylenediamines, e.g., N,N'-di-sec-butyl-p-phenylenediamine, dyes, metal deactivators, dehazers such as polyester-type ethoxylated alkylphenol-formaldehyde resins. Corrosion inhibitors, such as a polyhydric alcohol ester of a succinic acid derivative having on at least one of its alpha-carbon atoms an unsubstituted or substituted aliphatic hydrocarbon group having from 20 to 500 carbon atoms, for example, pentaerythritol diester of polyisobutylene-substituted succinic acid, the polyisobutylene group having an average molecular weight of about 950, in an amount from about 1 ppm by weight to about 1000 ppm by weight, may also be present. The fuels can also contain antiknock compounds such as methyl cyclopentadienylmanganese tricarbonyl and ortho-azidophenol as well as co-antiknock compounds such as benzoyl acetone.

An effective amount of one or more compounds of Formula I are introduced into the combustion zone of the engine in a variety of ways to prevent build-up of deposits, or to accomplish the reduction of intake valve deposits or the modification of existing deposits that are related to octane requirement. As mentioned, a preferred method is to add a minor amount of one or more compounds of Formula I to the fuel. For example, one or more compounds of Formula I are added directly to the fuel or are blended with one or more carriers and/or one or more additional detergents to form an additive concentrate which can be added at a later date to the fuel.

The amount of monoamide-containing polyether alcohol used will depend on the particular variation of Formula I used, the engine, the fuel, and the presence or absence of carriers and additional detergents. Generally, each compound of Formula I is added in an amount up to about 1000 ppm by weight, especially from about 1 ppm by weight to about 600 ppm by weight based on the total weight of the fuel composition. Preferably, the amount will be from about 50 ppm by weight to about 400 ppm by weight, and even more preferably from about 75 ppm by weight to about 250 ppm by weight based on the total weight of the fuel composition.

The carrier, when utilized, will have a weight average molecular weight from about 500 to about 5000. Suitable carriers, when utilized, include hydrocarbon based materials such as polyisobutylenes (PIB's), polypropylenes (PP's) and polyalphaolefins (PAO's); polyether based materials such as polybutylene oxides (poly BO's), polypropylene oxides (poly PO's), polyhexadecene oxides (poly HO's) and mixtures thereof (i.e.. both (poly BO)+(poly PO) and (poly-BO-PO)); and mineral oils such as Exxon Naphthenic 900 sus and high viscosity index (HVI) oils. The carrier is preferably selected from PIB's, poly BO's, and poly PO's, with poly BO's being the most preferred.

The carrier concentration in the final fuel composition is up to about 1000 ppm by weight. When a carrier is present, the preferred concentration is from about 50 ppm by weight to about 400 ppm by weight, based on the total weight of the fuel composition. Once the carrier is blended with one or more compounds of Formula I, the blend is added directly to the fuel or packaged for future use.

The fuel compositions of the present invention may also contain one or more additional detergents. When additional detergents are utilized, the fuel composition will comprise a mixture of a major amount of hydrocarbons in the gasoline boiling range as described hereinbefore, a minor amount of one or more compounds of Formula I as described hereinbefore and a minor amount of an additional detergent such as polyalkylenyl amines, Mannich amines, polyalkenyl succinimides, poly(oxyalkylene) carbamates, poly(alkenyl)-N-substituted carbamates and mixtures thereof. As noted above, a carrier as described hereinbefore may also be included. As used herein, the term "minor amount" means less than about 10% by weight of the total fuel composition, preferably less than about 1% by weight of the total fuel composition and more preferably less than about 0.1% by weight of the total fuel composition.

The polyalkylenyl amine detergents utilized comprise at least one monovalent hydrocarbon group having at least 50 carbon atoms and at least one monovalent hydrocarbon group having at most five carbon atoms bound directly to separate nitrogen atoms of a diamine. Preferred polyalkylenyl amines are polyisobutenyl amines. Polyisobutenyl amines are known in the art and representative examples are disclosed in various U.S. Patents including U.S. Pat. No. 3,753,670, U.S. Pat. No. 3,756,793, U.S. Pat. No. 3,574,576 and U.S. Pat. No. 3,438,757, each incorporated herein by reference. Particularly preferred polyisobutenyl amines for use in the present fuel composition include N-polyisobutenyl-N',N'-dimethyl-1,3-diaminopropane (PIB-DAP) and OGA-472 (a polyisobutenyl ethylene diamine available commercially from Oronite).

The Mannich amine detergents utilized comprise a condensation product of a high molecular weight alkyl-substituted hydroxyaromatic compound, an amine which contains an amino group having at least one active hydrogen atom (preferably a polyamine), and an aldehyde. Such Mannich amines are known in the art and are disclosed in U.S. Pat. No. 4,231,759, incorporated herein by reference. Preferably, the Mannich amine is an alkyl substituted Mannich amine.

The polyalkenyl succinimide detergents comprise the reaction product of a dibasic acid anhydride with either a polyoxyalkylene diamine, a hydrocarbyl polyamine or mixtures of both. Typically the succinimide is substituted with the polyalkenyl group but the polyalkenyl group may be found on the polyoxyalkylene diamine or the hydrocarbyl polyamine. Polyalkenyl succinimides are also known in the art and representative examples are disclosed in various U.S. Patents including U.S. Pat. No. 4,810,261, U.S. Pat. No. 4,852,993, U.S. Pat. No. 4,968,321, U.S. Pat. No. 4,985,047; U.S. Pat. No. 5,061,291 and U.S. Pat. No. 5,147,414, each incorporated herein by reference.

The poly(oxyalkylene) carbamate detergents comprise an amine moiety and a poly(oxyalkylene) moiety linked together through a carbamate linkage, i.e., $$—O—C(O)—N— \quad \text{(VIII)}$$

These poly(oxyalkylene) carbamates are known in the art and representative examples are disclosed in various U.S. Patents including, U.S. Pat. No. 4,191,537, U.S. Pat. No. 4,160,648, U.S. Pat. No. 4,236,020, U.S. Pat. No. 4,270,930, U.S. Pat. No. 4,288,612 and U.S. Pat. No. 4,881,945, each incorporated herein by reference. Particularly preferred poly (oxyalkylene) carbamates for use in the present fuel composition include OGA-480 (a poly(oxyalkylene) carbamate which is available commercially from Oronite).

The poly(alkenyl)-N-substituted carbamate detergents utilized are of the formula:

(IX)

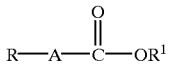

in which R is a poly(alkenyl) chain; $R^1$ is a hydrocarbyl or substituted hydrocarbyl group; and A is an N-substituted amino group. Poly(alkenyl)-N-substituted carbamates are known in the art and are disclosed in U.S. Pat. No. 4,936,868, incorporated herein by reference.

The one or more additional detergents are added directly to the hydrocarbons, blended with one or more carriers, blended with one or more compounds of Formula I, or blended with one or more compounds of Formula I and one or more carriers before being added to the hydrocarbons.

The concentration of the one or more additional detergents in the final fuel composition is generally up to about 1000 ppm by weight for each additional detergent. When one or more additional detergents are utilized, the preferred concentration for each additional detergent is from about 50 ppm by weight to about 400 ppm by weight, based on the total weight of the fuel composition, even more preferably from about 75 ppm by weight to about 250 ppm by weight, based on the total weight of the fuel composition.

Engine Tests

Decreasing Intake Valve Depsits

The invention further provides a process for decreasing intake valve deposits in engines utilizing the monoamide-containing polyether alcohols of the present invention. The process comprises supplying to and combusting or burning in an internal combustion engine a fuel composition comprising a major amount of hydrocarbons in the gasoline boiling range and a minor amount of one or more compounds of Formula I as described hereinbefore.

By supplying to and combusting or burning the fuel composition in an internal combustion engine, deposits in the induction system, particularly deposits on the tulips of the intake valves, are reduced. The reduction is determined by running an engine with clean induction system components and pre-weighed intake valves on dynamometer test stands in such a way as to simulate road operation using a variety of cycles at varying speeds while carefully controlling specific operating parameters. The tests are run for a specific period of time on the fuel composition to be tested. Upon completion of the test, the induction system deposits are visually rated, the valves are reweighed and the weight of the valve deposits is determined.

Controlling Octane Requirement Increases

The invention further provides a process for controlling octane requirement increases in engines utilizing the monoamide-containing polyether alcohols of the present invention. The process comprises supplying to and combusting or burning in an internal combustion engine a fuel composition comprising a major amount of hydrocarbons in the gasoline boiling range and a minor amount of one or more compounds of Formula I as described hereinbefore.

Octane requirement is the maximum octane number of a gasoline that presents trace knock in a given engine within the engine's normal operating range. An increase in octane requirement is generally experienced during mileage accumulation on a new engine. The increase is typically attributed to an increase in engine deposits. Octane requirement increase control is a performance feature that is usually expressed as a comparison of the octane requirement increase developed with a gasoline containing additives (test gasoline) relative to a version of the same gasoline without additives (base gasoline), i.e., the positive difference obtained by subtracting the results of gasoline containing additives from gasoline which does not contain additives.

The test protocol for octane requirement increase control must establish the stable octane requirement of the base gasoline relative to a clean engine. Base gasoline is typically the test gasoline without additives or special treatment; however, it may be gasoline containing additives for a specific comparison.

Octane requirement increase control testing consists of operating an engine assembled with clean combustion chambers and induction system components on a test gasoline to octane stabilization, measuring the octane requirement at regular intervals. The octane requirement increase control is the difference between the stabilized octane requirement of the engine operated on test gasoline and that of the stabilized octane requirement of the engine on base gasoline.

Reduction of Octane Requirement

The invention still further provides a process for reducing octane requirement in engines utilizing the monoamide-containing polyether alcohols of the present invention. The process comprises supplying to and combusting or burning in an internal combustion engine a fuel composition comprising a major amount of hydrocarbons in the gasoline boiling range and a minor amount of one or more compounds of Formula I as described hereinbefore.

Octane requirement reduction is the reduction of the octane requirement of an engine by the action of a particular gasoline, usually measured as a decrease from a stabilized octane requirement condition.

Octane requirement reduction is a performance feature that demonstrates a reduction from the established octane requirement of a base gasoline in a given engine. Octane requirement reduction testing consists of operating an engine, which has achieved stable octane requirement using base gasoline, on a test gasoline for approximately 100 to 250 hours. Octane measurements are made daily and octane requirement reduction is a reduction of octane requirement from that of base gasoline. Several octane requirement reduction tests may be conducted in a series for fuel to fuel comparison, or test fuel to base fuel comparison, by restabilizing on base fuel between octane requirement reduction tests.

The contribution of specific deposits is determined by removing deposits of interest and remeasuring octane requirement immediately after the engine is warmed to operating temperature. The octane requirement contribution of the deposit is the difference in ratings before and after deposit removal.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

The invention will be described by the following examples which are provided for illustrative purposes and are not to be construed as limiting the invention.

EXAMPLES

Compound Preparation

The monoamide-containing polyether alcohols used in the following examples were prepared by reacting one or more initiators with one or more epoxides in the presence of a potassium compound to produce compounds of Formula I having a weight average molecular weight from about 600 to about 4000. The weight average molecular weight (MW) was measured by gel permeation chromatography (GPC). Rotary evaporation was typically conducted at a temperature from about room temperature to about 120° C.

Example 1

N-acetylmonoethanolamine (161 g, 1.56 moles) was placed in a one liter flask. Under nitrogen atmosphere, potassium hydride (5.0 g) was added portion-wise while the mixture was stirred. Hydrogen gas evolution was observed. After the gas evolution ceased, the mixture was charged into a one gallon autoclave reactor equipped with a heating device, temperature controller, mechanical stirrer and water cooling system along with 1,2-epoxybutane (2340 g, 32.5 moles). The autoclave reactor was sealed, purged with nitrogen to remove air and pressurized to an initial pressure of about 200 psi with nitrogen. The mixture was then heated to a temperature of 140° C. for six hours. The autoclave reactor was cooled to room temperature and excess gas was vented. The crude product was recovered and non-reacted 1,2-epoxybutane was removed by rotary evaporation. The product was then extracted with water to remove impurities and rotary evaporation was repeated to obtain a final product. GPC analysis showed MW=1280 and a polydispersity of 1.07.

Examples 1.1–1.4 are included to demonstrate alternative methods to make Example 1.

Example 1.1

The procedure of Example 1 was repeated with the following exceptions: N-acetylethanolamine (34 g, 0.33 mole) and potassium hydride (1.2 g) were mixed and charged along with 1,2-epoxybutane (466 g, 6.47 moles) into a one liter autoclave reactor; the initial pressure was 50 psi; the mixture was heated to a temperature of 136° C. for six hours; the resulting product was then extracted with hexane/water and ethanol to remove impurities and rotary evaporation was repeated to obtain a final product. GPC analysis showed MW=1340 and a polydispersity of 1.07.

Example 1.2

The procedure of Example 1 was repeated with the following exceptions: N-acetylethanolamine (206 g, 2.0 moles) and potassium hydride (5.0 g) were mixed and charged along with 1,2-epoxybutane (1800 g, 25.0 moles) into a one gallon autoclave reactor; the mixture was heated to a temperature of 136° C.–146° C. for five hours. GPC analysis showed MW=912 and a polydispersity of 1.04.

Example 1.3

N-acetylethanolamine (38.6 g, 0.37 mole) and potassium t-butoxide (3.4 g) were mixed and subjected to rotary evaporation under reduced pressure to remove t-butanol. The mixture was then charged along with 1,2-epoxybutane (461 g, 6.4 moles) into a one liter autoclave reactor. From this point on, the procedure of Example 1 was followed with the following exceptions: the initial pressure was 50 psi; and the mixture was heated to a temperature of 133° C.–141° C. for six hours. GPC analysis showed MW=1220 and a polydispersity of 1.05.

Example 1.4

A mixture of N-acetylethanolamine (25.8 g, 0.25 mole) and potassium hydroxide (5 pellets) was subjected to rotary evaporation under reduced pressure to remove water. The mixture was then charged along with 1,2-epoxybutane (374 g, 5.19 moles) into a one liter autoclave reactor. From this point on, the procedure of Example 1 was followed with the following exceptions: the initial pressure was 50 psi and the mixture was heated to a temperature of 135° C. for eight hours. GPC analysis showed MW=1160 and a polydispersity of 1.08.

Example 2

The procedure of Example 1 was repeated with the following exceptions: N-acetylethanolamine (117 g, 1.13 moles) and potassium hydride (5.0 g) were mixed and charged along with 1,2-epoxybutane (2383 g, 32.6 moles) into a one gallon autoclave reactor; and the mixture was heated to a temperature of 137° C.–145° C. for six hours. GPC analysis showed MW=1660 and a polydispersity of 1.08.

Example 3

The procedure of Example 1 was repeated with the following exceptions: N-acetylethanolamine (41.2 g, 0.40 mole) and potassium hydride (1.4 g) were mixed and charged along with propylene oxide (279 g, 4.8 moles) and 1,2-epoxybutane (279 g, 3.9 moles) into a one liter autoclave reactor; the initial pressure was 50 psi; and the mixture was heated to a temperature of 134° C.–145° C. for three hours. GPC analysis showed MW=1250 and a polydispersity of 1.09.

Example 4

The procedure of Example 1 was repeated with the following exceptions: N-acetylethanolamine (34.3 g, 0.59 moles) and potassium hydride (1.4 g) were mixed and charged along with propylene oxide (465 g, 8.01 moles) into a one liter autoclave reactor; the initial pressure was 50 psi; and the mixture was heated to a temperature of 137° C.–140° C. for four hours. GPC analysis showed M=1270 and a polydispersity of 1.09.

Example 5

The procedure of Example 1 was repeated with the following exceptions: N-acetylethanolamine (38.6 g, 0.374 mole) and potassium hydride (2.8 g) were mixed and charged along with propylene oxide (393 g, 6.78 mole) and para-nonylphenol glycidyl ether (168 g, 0.60 mole) into a one liter autoclave reactor; the initial pressure was 50 psi; the mixture was heated to a temperature of 137° C.–140° C. for six hours. GPC analysis showed MW=1200 and a polydispersity of 1.08.

Example 6

The procedure of Example 1 was repeated with the following exceptions: N-acetylethanolamine (161 g, 1.56 moles) and potassium hydride (5.0 g) were mixed and charged along with 1,2-epoxybutane (1638 g, 22.8 moles) and para-nonylphenol glycidyl ether (702 g, 2.54 moles) into a one gallon autoclave reactor; and the mixture was heated to a temperature of 141° C.–147° C. for seven hours. GPC analysis showed MW=1160 and a polydispersity of 1.10.

Example 7

The procedure of Example 1 was repeated with the following exceptions: N-acetylethanolamine (38.6 g, 0.37 mole) and potassium hydride (1.2 g) were mixed and charged along with 1,2-epoxybutane (421 g, 5.8 moles) and propylene oxide (140 g, 2.4 moles) into a one liter autoclave reactor; the initial pressure was 50 psi; and the mixture was heated to a temperature of 138° C. for five hours. GPC analysis showed W=1330 and a polydispersity of 1.07.

Example 8

The procedure of Example 1 was repeated with the following exceptions: N-acetylmonoethanolamine (38.6 g, 0.375 mole) and potassium hydride (1.4 g) were mixed and charged along with 1,2-epoxybutane (449 g, 6.2 moles) and 1,2-epoxydodecane (112 g, 0.61 mole) into a one liter autoclave reactor; the initial pressure was 50 psi; and the mixture was heated to a temperature of 137° C.–145° C. for six hours. GPC analysis showed MW=1220 and a polydispersity of 1.08. The hydroxy number was 83 mg KOH/g.

Example 9

The experimental procedure of Example 1 was repeated with the following exceptions: Coconut diethanolamide (from Henkel, 57 g, 2.6 moles) and potassium hydride (1.2 g) were mixed and charged along with 1,2-epoxybutane (428 g, 5.9 moles) into a one liter autoclave reactor; the initial pressure was 50 psi; and the mixture was heated to a temperature of 138–142° C. for four hours. GPC analysis showed MW=1660 and a polydispersity of 1.08. The hydroxy number was 64 mg KOH/g and IR showed 1700 cm-1 (w) and 1610 cm-1 (s).

Example 9.1

The same procedure of Example 9 was followed to achieve a compound having a GPC which showed MW=1310 and a polydispersity of 1.08.

Example 9.2

The same procedure of Example 9 was followed to achieve a compound having a GPC which showed MW=1140 and a polydispersity of 1.05.

Example 9.3

The same procedure of Example 9 was followed to achieve a compound having a GPC which showed MW=827 and a polydispersity of 1.03.

Example 10

A mixture of coconut diethanolamide (from Henkel, 83 g, 0.373 mole) and potassium hydroxide (50% in water, 3.4 g) was subjected to rotary evaportion under reduced pressure to remove water. The mixture was then charged along with 1,2-epoxybutane (407 g, 5.65 moles) and para-nonylphenyl glycidyl ether (110 g, 0.4 mole) into a one liter autoclave reactor. From this point on, the procedure of Example 1 was followed with the following exceptions: the initial pressure was 50 psi and the mixture was heated to a temperature of 112° C.–123° C. for 8 hours. GPC analysis showed MW=1130 and a polydispersity of 1.08.

Example 11

Step 1—Preparation of Initiator

While stirring under nitrogen atmosphere, a mixture of methyl laurate (214 g, 1.0 mole) and 2-ethyl-aminoethanol (89 g, 1.0 mole) was heated to approximately 150° C. to remove methanol. The product, an amido alcohol of the formula $$C_{11}H_{23}\overset{\overset{\displaystyle O}{\|}}{C}N(C_2H_5)CH_2CH_2OH$$

was confirmed by NMR.

Step 2—Butoxylation

A mixture of the Initiator of Step 1 (102 g, 0.376 mole) and potassium hydroxide (1.7 g in 1.7 g water) was subjected to rotary evaporation under reduced pressure to remove water. The mixture was then charged along with 1,2-epoxybutane (498 g, 6.92 moles) into a one liter autoclave reactor. From this point on, the procedure of Example 1 was followed with the following exceptions: the initial pressure was 50 psi and the mixture was heated to a temperature of 137–140° C. for 4 hours. GPC analysis showed MW=1330 and a polydispersity of 1.10.

Example 12

Step 1—Preparation of Initiator

While stirring under nitrogen atmosphere, a mixture of 2-ethyl hexanoic acid (144 g, 1.0 mole), octadecylamine (269 g, 1.0 mole) and xylene solvent (100 g) was heated to 150–160° C. for 2 hours and then to 182–196° C. for six hours. During the process, water and xylene solvent were removed from the mixture. The resulting product was confirmed by NMR to be the amide of 2-ethylhexanoic acid and octadecylamine.

Step 2—Butoxylation

A mixture of the Initiator of Step 1 (114 g, 0.31 mole) and potassium hydroxide (1.5 g in 1.5 g water) was subjected to rotary evaporation under reduced pressure. The mixture was then charged along with 1,2-epoxybutane (386 g, 5.36 moles) into a one liter autoclave reactor. From this point on, the procedure of Example 1 was repeated with the following exceptions: the initial pressure was 50 psi and the mixture was heated to a temperature of 127–142° C. for 7 hours. GPC analysis showed MW=1250 and a polydispersity of 1.14.

Example 13

Step 1—Preparation of Initiator 3-methoxypropylamine (178 g, 2.0 moles) and gamma-butyrolactone (172 g, 2.0 moles) were added to a one liter, 4-necked round bottom flask, equipped with a mechanical stirrer, water condenser and nitrogen inlet-outlet flow. While stirring under nitrogen atmosphere, the mixture was slowly heated to temperatures of 64° C., 125° C. and 135° C. over an 8 hour period of time. NMR analysis indicated 94% of an amide adduct of the 3-methoxypropylamine and gamma-butyrolactone product of the formula:

$$CH_3OCH_2CH_2CH_2NH\overset{\overset{\displaystyle O}{\|}}{C}CH_2CH_2CH_2OH$$

Step 2—Butoxylation

The Initiator of Step 1 (65.6 g, 0.375 mole) and potassium hydride (1.2 g) were mixed and charged along with 1,2-epoxybutane (534 g, 7.42 moles) into a one liter autoclave reactor. From this point on, the procedure of Example 1 was followed with the following exceptions: the initial pressure was 50 psi; and the mixture was heated to a temperature of 137–141° C. for eight hours. GPC analysis showed MW=1280 and a polydispersity of 1.09. The hydroxy number was 79 mg KOH/g and IR analysis showed 1660 cm-1 (s) and 1765 cm-1 (w).

Example 14

Step 1—Preparation of Initiator

Gamma-butyrolactone (86 g, 1.0 mole) and N-methylcyclohexylamine (113 g, 1.0 mole) were added to a 1 liter, 4-necked round bottom, equipped with a mechanical stirrer, water condenser and nitrogen inlet-outlet flow. While stirring, under nitrogen atmosphere, the mixture was heated to 100° C.–130° C. for approximately four hours. NMR analysis of the final product indicated 68% of the desired amide adduct of gamma-butyrolactone/N-methylcyclohexylamine, 16% of gamma-butyrolactone and 16% N-methylcyclohexylamine. The initiator was used without further purification.

Step 2—Butoxylation

A mixture of the Initiator of Step 1 (75 g, ca. 0.37 mole) and potassium hydroxide (1.9 g in 1.9 g water) was subjected to rotary evaporation under reduced pressure at 80° C. to remove water. The mixture was then charged along with 1,2-epoxybutane (525 g, 7.29 moles) into a one liter autoclave reactor. From this point on, the procedure of Example 1 was then followed with the following exceptions: the initial pressure was 50 psi; and the mixture was heated to a temperature of 120° C.–138° C. for 10 hours. GPC analysis showed MW=1290 and a polydispersity of 1.21.

Example 15

Coconut amide of monoethanolamine (EMID® 6500 Coconut Monoethanolamide, from Henkel Corporation, 78 g, 0.31 mole) and potassium t-butoxide (2.0 g) were mixed and subjected to rotary evaporation under reduced pressure to remove t-butanol. The mixture was then charged along with 1,2-epoxybutane (422 g, 5.9 moles) into a one liter autoclave reactor. From this point on, the procedure of Example 1 was followed with the following exceptions: the initial pressure was 50 psi; the mixture was heated to a temperature of 137° C.–152° C. for 7.5 hours. GPC analysis showed MW=1230 and a polydispersity of 1.07. The hydroxy number was 85 mg KOH/g and IR was 1750 cm-1 and 1660 cm-1(s).

Example 15.1

This example is included to demonstate an alternative method for preparing Example 15.

Lauramide ethanolamine (MEA) (from McIntyre Chemical, Tradename MACKAMIDE LLM, 91 g, 0.37 mole) and potassium hydroxide 1.5 g) were mixed and subjected to rotary evaporation under reduced pressure at 80° C. The mixture was then charged along with 1,2-epoxybutane (509 g, 7.1 moles) into a one liter autoclave. The procedure of Example 1 was followed from this point with the following exceptions: the initial pressure was 50 psi; and the mixture was heated to a temperature of 118° C.–120° C. for 10 hours. GPC analysis showed MW=1230 and a polydispersity of 1.05.

Example 15.2

The same procedure of Example 15 was followed to achieve a compound having a GPC which showed MW=1530 and a polydispersity of 1.05.

Example 15.3

The same procedure of Example 15 was followed to achieve a compound having a GPC which showed MW=1090 and a polydispersity of 1.06.

Example 16

Coconut amide of monoethanolamine (EMID® 6500 Coconut Monoethanolamide, from Henkel Corporation, 93 g, 0.37 mole) and potassium hydroxide (2.0 g) were mixed and subjected to rotary evaporation under reduced pressure at 80° C. The mixture was then charged along with 1,2-epoxybutane (397 g, 5.5 moles) and nonylphenol glycidyl ether (110 g, 0.38 mole) into a one liter autoclave reactor. From this point on, the procedure of Example 1 was followed with the following exceptions: the initial pressure was 50 psi; the mixture was heated to a temperature of 118° C.–120° C. for 12 hours. GPC analysis showed MW=1220 and a polydispersity of 1.08.

Example 17

The experimental procedure of Example 1 was repeated with the following exceptions: a mixture of N-methylacetamide (23 g, 0.31 mole) and potassium hydride (1.0 g) were charged along with 1,2-epoxybutane (477 g, 6.6 moles) into a one liter autoclave reactor; this initial pressure was 50 psi; and the mixture was heated to a temperature of 139–149° C. for 7 hours. GPC analysis showed MW=1270 and a polydispersity of 1.10. The hydroxy number was 48 KOH/g.

Example 18

Step 1: Preparation of Initiator

Methoxypropylamine (177 g, 2.0 moles) and ethyl acetate (264 g, 3.0 moles) were charged into a one liter autoclave reactor. The autoclave reactor was sealed, flushed with nitrogen to remove air and pressurized with nitrogen to 50 psi. The mixture was heated to 170° C.–200° C. for 6 hours. During the process, a maximum pressure of 245 psi was recorded. The autoclave reactor was cooled to room temperture and excess gas was vented. Unreacted ethyl acetate was removed by rotary evaporation under reduced pressure. The final product, N-acetyl methoxylpropylamine showed 98% purity by NMR.

Step 2: Butoxylation

The initiator of Step 1 (N-acetyl methoxypropylamine, 49 g, 0.37 mole) and potassium hydroxide (2.1 g) were mixed and subjected to rotary evaporation under reduced pressure at 80° C. The mixture was then charged along with 1,2-epoxybutane (551 g, 7.65 moles) into a one liter autoclave reactor. From this point on, the procedure of Example 1 was followed with the following exceptions: the initial pressure was 50 psi; and the mixture was heated to 133° C.–135° C. for 8 hours. GPC analysis showed MW=1340 and a polydispersity of 1.06.

Example 19

Step 1—Preparation of Initiator

A mixture of 2-ethylhexanoic acid (288 g, 2.0 mole) and 2-(2-aminoethoxyl)ethanol (210 g, 2.0 moles) was heated to a temperature of 150° C.–200° C. for over 5 hours to remove water. A light colored product of the formula:

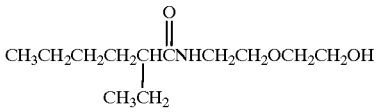

was formed and confirmed by NRM analysis to be 96% pure.

Step 2—Butoxylation

A mixture of the Initiator of Step 1 (86.6 g, 0.375 mole) and potassium-t-butoxide (1.7 g) was subjected to rotary evaporation under reduced pressure. The mixture was then charged along with 1,2-epoxbutane (513 g, 7.1 mole) into a one liter autoclave reactor. The procedure of Example 1 was then followed with the following exceptions: the initial pressure was 50 psi; and the mixture was heated to 137° C.–141° C. for 6 hours. GPC analysis showed MW=1200 and a polydispersity of 1.05. The hydroxy number was 82 mg KOH/g.

Example 20

A mixture of 9-Octadecenamide-N,N-bis(2-hydroxyethyl) (from Henkel, Tradename EMID® 6545-Oleic DEA, 111 g, 0.3 mole), potassium hydroxide (1.4 g in 1.0 g water) and toluene (50 g) was subjected to rotary evaporation under reduced pressure. The mixture was then charged along with 1,2-epoxybutane (489 g, 6.8 moles) into a one gallon autoclave. The procedure of Example 1 was followed from this point with the following exceptions: the mixture was heated to a temperature of 140° C. for 4 hours. GPC analysis showed MW=1680 and a polydispersity of 1.11. The hydroxy number was 63 mg KOH/g.

Example 20.1

The same procedure used to prepare the compound of Example 20 was used to compare a compound having a GPC which showed MW=1350 and a polydispersity of 1.09.

Example 21

N-methyl formamide (22 g, 0.37 mole) and potassium hydroxide (0.85 g) were directly charged along with 1,2-epoxybutane (578 g, 8.0 mole) into a one liter autoclave reactor. From this point on, the procedure of Example 1 was followed with the following exceptions: the initial pressure was 50 psi; the mixture was heated to a temperature of 135–148° C. and the reaction time was 11 hours. GPC analysis showed MW=1190 and a polydispersity of 1.12. The hydroxy number was 55 mg KOH/g.

Example 22

Acetamide (22 g, 0.37 mole) and potassium hydroxide (0.85 g) were directly charged along with 1,2-epoxybutane (578 g, 8.0 moles) into a one liter autoclave reactor. From this point on, the procedure of Example 1 was followed with the following exceptions: the initial pressure was 50 psi; the mixture was heated to a temperature of 136–138° C. and the reaction time was 12 hours. GPC analysis showed MW=1170 and a polydispersity of 1.05. The hydroxy number was 88 mg KOH/g.

Example 23

Octadecanamide (from Aldrich Chemical Company, 101 g, 0.36 mole), potassium t-butoxide (3.4 g) and 1,2-epoxybutane (470 g, 6.5 moles) were charged directly into a one liter autoclave. From this point on, the procedure of Example 1 was followed with the following exceptions: the initial pressure was 52 psi; the mixture was heated to a temperature of 120° C.–133° C. for 6 hours. GPC analysis showed M=1340 and a polydispersity of 1.06.

Example 24

Step 1—Preparation of Initiator

Diethanolamine (265 g, 2.5 moles) and n-butyl acetate (348 g, 3.0 moles) were charged into a one liter autoclave reactor. The autoclave reactor was sealed, purged with nitrogen to remove air and pressurized to an initial pressure of 50 psi at room temperature. The mixture was heated to 156–175° C. for 8 hours. The autoclave reactor was then cooled to room temperature. The resulting initiator was then subjected to rotary evaporation under reduced pressure to produce a final initiator of the formula:

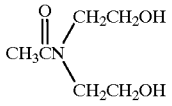

NMR analysis showed 67% purity.

Step 2—Butoxylation

The initiator of Step 1 (55 g, 0.37 mole) and potassium hydroxide (1.7 g in 1.0 g water) were subjected to rotary evaporation under reduced pressure. The resulting mixture was charged along with 1,2-epoxybutane (545 g, 7.6 moles) into a one liter autoclave. From this point on, the procedure of Example 1 was followed with the following exceptions: the initial pressure was 52 psi and the mixture was heated to a temperature of 127° C.–141° C. for 7 hours. GPC analysis showed MW=1540 and a polydispersity of 1.07.

Example 25

Step 1—Prepartion of Initiator

An adduct of morpholine and gamma-butyrolactone was obtained by mixing morpholine (348 g, 4.0 moles) and gamma-butyrolactone (344 g, 4.0 moles) and heating to a temperature of 100–140° C. for 5 hours. NMR analysis showed a 92% yield.

Step 2—Butoxylation

The initiator of Step 1 (64.9 g, 0.38 moles) and potassium t-butoxide (3.4 g) were mixed and subjected to rotary evaportion under reduced pressure. The mixture was then charged along with 1,2-epoxybutane (535 g, 7.4 moles) into a 1 liter autoclave. From this point on, the procedure of Example 1 was followed with the following exceptions: the initial pressure was 52 psi and the mixture was then heated to a temperature of 127° C.–137° C. for 3 hours. GPC analysis showed MW=1630 and a polydispersity of 1.25.

Example 26

Step 1—Preparation of Initiator

Monoethanolamine (305 g, 5.0 moles) and gamma-butyrolactone (430 g, 5.0 moles) were mixed slowly and heated to a temperature of 96–133° C. for 7 hours. NMR analysis showed an initiator of the formula:

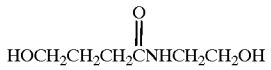

with 97% yield.

Step 2—Butoxylation

The initiator of Step 1 (55 g, 0.37 mole) and potassium t-butoxide were mixed and subjected to rotary evaportion under reduced pressure. The mixture was then charged along with 1,2-epoxybutane (545 g, 7.6 moles) into a 1 liter autoclave reactor. From this point on, the procedure of Example 1 was followed with the following exceptions: the initial pressure was 50 psi and the mixture was heated to a temperature of 117° C.–142° C. for 8 hours. GPC analysis showed MW=1320 and a polydispersity of 1.09. The hydroxy number was 106 mg KOH/g.

Example 27

Step 1—Preparation of Initiator

Ethanolamine (122 g, 2.0 moles) and caprolactone (282 g, 2.0 moles) were mixed and heated to a temperature of 135–148° C. for 7 hours. An initiator of the formula:

$$HOCH_2CH_2CH_2CH_2CH_2\overset{\overset{\displaystyle O}{\|}}{C}NHCH_2CH_2OH$$

was achieved. NMR analysis showed a 70% yield.

Step 2—Butoxylation

The initiator of Step 1 (76 g, 0.38 mole) and potassium hydroxide (1.7 g in 1.7 g water) were subjected to rotary evaportion under reduced pressure. The mixture was then charged along with 1,2-epoxybutane (524 g, 7.3 moles) into a 1 liter autoclave reactor. From this point on, the procedure of Example 1 was followed with the following exceptions: the initial pressure was 50 psi and the mixture was heated to a temperature of 123° C.–126° C. for 10 hours. GPC analysis showed MW=1200 and a polydispersity of 1.03.

Example 28

Step 1—Preparation of Initiator

Steramide (Kenamide® S Fatty Amide, 106 g, 0.37 mole) and potassium t-butoxide was directely charged into a one liter autoclave along with 1,2-epoxybutane (494 g, 6.86 moles). From this point on, the procedure of Example 1 was followed with the following exceptions: the initial pressure was 50 psi; and the mixture was heated to a temperature of 120° C.–134° C. for 7 hours. GPC analysis showed MW=1390 and a polydispersity of 1.04.

Test Results

In each of the following tests, the base fuel utilized comprised either premium unleaded gasoline (PU) (90+ octane, (R+M/2|) and/or regular unleaded gasoline (RU) (85–88 octane, [R+M/2]). Those skilled in the art will recognize that fuels containing heavy catalytically cracked stocks, such as most regular fuels, are typically more difficult to additize in order to control deposits and effectuate octane requirement reduction and octane requirement increase control. The monoamide-containing polyether alcohol compounds utilized were prepared as indicated by Example number and were used at the concentration indicated in parts per million (ppm) by weight. The tests employed are described below and the results of the various tests are set forth in the tables below.

Intake Valve Deposit Tests

Engines from vehicles were installed in dynamometer cells in such a way as to simulate road operation using a cycle of idle, low speed and high speed components while carefully controlling specific operating parameters. Fuels with and without the compounds of Formula I were tested in a variety of engines having port fuel injection including, 2.3 L Ford, 3.0 L Ford, 3.3 L Dodge, 2.3 L Oldsmobile (Olds), 2.8 L Chevrolet (Chev), 3.1 L Chevrolet (Chev) and 2.7 L BMW to determine the effectiveness of the instant compounds in reducing intake valve deposits ("L" refers to liter). Carbureted 0.359 L Honda generator engines were also utilized to determine the effectiveness of the instant compounds in reducing intake valve deposits.

Before each test, the engine was inspected, the induction system components were cleaned and new intake valves were weighed and installed. The oil was changed and new oil and fuel filters, gaskets and spark plugs were installed.

In all engines except the Honda, the tests were run in cycles consisting of idle, 35 mph and 65 mph for a period of 100 hours unless indicated otherwise. In the Honda engines, the tests were run in cycles consisting of a no load idle mode for one minute followed by a three minute mode with a load at 2200 rpm's for a period of 40 hours unless indicated otherwise. At the end of each test, the intake valves were removed and weighed.

Honda generator engine results obtained using the monoamide-containing polyether alcohols of the present invention are included in the tables below. All tests of the compounds of the present invention were carried out with additive concentrations (the amount of Compound Example # used) of 200 parts per million (ppm) non-volatile matter (nvm). Base Fuel results which have 0 ppm additive are also included for comparison purposes. The base fuels are indicated by the absence of a Compound Example # (indicated in the Compound Example # column by "--").

TABLE 2

Intake Valve Deposits in Honda Generator Engines Using Monobutoxylated Compounds

| Compound Example # | Fuel | Engine | Conc. ppm By Weight | Avg. Dep. Wt. (mg) |
|---|---|---|---|---|
| 4 | PU | H3A | 200 | 28.5 |
| -- | " | " | 0 | 39.2 |
| 17 | PU | H4B | 200 | 15.8 |
| -- | " | " | 0 | 63.0 |
| 17 | PU | H4A | 200 | 9.5 |
| -- | " | " | 0 | 17.3 |
| 14 | PU | H3A | 200 | 8.7 |
| -- | " | " | 0 | 39.2 |
| 11 | PU | H4A | 200 | 14.6 |
| -- | " | " | 0 | 17.3 |
| 21 | PU | H4A | 200 | 7.1 |
| -- | " | * | 0 | 60.3 |
| 25 | PU | H2C | 200 | 13.3 |
| -- | " | * | 0 | 57.1 |

--Indicates the results achieved with base fuel in the absence of any additive compound (0 ppm additive compound).
*Indicates that this was an average of 4 runs in the same base fuel in other Honda generator engines.

TABLE 3

Intake Valve Deposits in Honda Generator Engines Using Dibutoxylated Compounds

| Compound Example # | Fuel | Engine | Conc. ppm By Weight | Average Deposit Weight (mg) |
|---|---|---|---|---|
| 1 | PU | H3A | 200 | 5.8 |
| -- | " | * | 0 | 60.3 |
| 1 | PU | H3B | 200 | 22.3 |
| -- | " | " | 0 | 71.6 |
| 1 | PU | H4A | 200 | 19.6 |
| -- | " | * | 0 | 60.3 |
| 1 | PU | H5A | 200 | 8.9 |
| -- | " | " | 0 | 49.8 |
| 1 | RU | H5A | 200 | 42.7 |
| -- | " | ** | 0 | 69.1 |
| 2 | PU | H3A | 200 | 16.3 |
| -- | " | " | 0 | 39.2 |

TABLE 3-continued

Intake Valve Deposits in Honda Generator Engines Using Dibutoxylated Compounds

| Compound Example # | Fuel | Engine | Conc. ppm By Weight | Average Deposit Weight (mg) |
|---|---|---|---|---|
| 2 | PU | H6A | 200 | 14.2 |
| -- | " | *** | 0 | 28.0 |
| 2 | PU | H7A | 200 | 41.3 |
| -- | " | *** | 0 | 28.0 |
| 3 | PU | H3A | 200 | 28.3 |
| -- | " | " | 0 | 39.2 |
| 6 | PU | H3A | 200 | 3.6 |
| -- | " | " | 0 | 39.2 |
| 15 | RU | H3A | 200 | 26.7 |
| -- | " | " | 0 | 97.9 |
| 15 | PU | H4A | 200 | 9.1 |
| -- | " | " | 0 | 17.3 |
| 15 | PU | H4A | 200 | 17.5 |
| -- | " | * | 0 | 60.3 |
| 15.2 | PU | H4A | 200 | 12.8 |
| -- | " | " | 0 | 17.3 |
| 15.3 | RU | H4A | 200 | 43.5 |
| -- | " | " | 0 | 40.2 |
| 16 | PU | H4A | 200 | 7.5 |
| -- | " | " | 0 | 17.3 |
| 9 | PU | H4A | 200 | 20.9 |
| -- | " | " | 0 | 17.3 |
| 9.1 | PU | H4A | 200 | 10.7 |
| -- | " | " | 0 | 17.3 |
| 9.2 | PU | H4A | 200 | 25.7 |
| -- | " | " | 0 | 17.3 |
| 9.3 | PU | H4A | 200 | 46.2 |
| -- | " | " | 0 | 17.3 |
| 10 | PU | H4A | 200 | 26.3 |
| -- | " | " | 0 | 17.3 |
| 20 | PU | H4A | 200 | 13.9 |
| -- | " | " | 0 | 17.3 |
| 20.1 | PU | H4A | 200 | 36.7 |
| -- | " | " | 0 | 17.3 |
| 12 | PU | H3A | 200 | 10.3 |
| -- | " | " | 0 | 39.2 |
| 23 | PU | H5A | 200 | 15.5 |
| -- | " | * | 0 | 60.3 |
| 22 | PU | H4A | 200 | 2.5 |
| -- | " | * | 0 | 60.3 |
| 22 | PU | H3B | 200 | 41.1 |
| -- | " | " | 0 | 71.6 |
| 24 | PU | H3B | 200 | 33.7 |
| -- | " | " | 0 | 71.6 |
| 19 | PU | H3B | 200 | 21.2 |
| -- | " | " | 0 | 71.6 |
| 19 | PU | H2C | 200 | 27.6 |
| -- | " | " | 0 | 57.1 |
| 19 | PU | H3A | 200 | 7.9 |
| -- | " | * | 0 | 60.3 |
| 28 | RU | H3C | 200 | 30.8 |
| -- | " | *** | 0 | 45.9 |

--Indicates the results achieved with base fuel in the absence of any additive compound (0 ppm additive compound).
*Indicates that this was an average of 4 runs in the same base fuel in other Honda generator engines.
**Indicates that this was an average of 2 runs in the same base fuel in other Honda generator engines.
***Indicates that this was an average of 8 runs in the same base fuel in other Honda generator engines.
****Indicates that this was an average of 4 runs in the same base fuel in other Honda generator engines.

TABLE 4

Intake Valve Deposits in Honda Generator Engines Using Tributoxylated Monoamide-containings

| Compound Example # | Fuel | Engine | Conc. ppm By Weight | Average Deposit Weight, mg |
|---|---|---|---|---|
| 26 | PU | H2C | 200 | 18.6 |
| -- | " | " | 0 | 57.1 |
| 27 | PU | H4A | 200 | 11.7 |
| -- | " | " | 0 | 17.3 |
| 13 | PU | H4A | 200 | 14.6 |
| -- | " | * | 0 | 60.3 |

--Indicates the results achieved with base fuel in the absence of any additive compound (0 ppm additive compound).
*Indicates that this was an average of 4 runs in the same base fuel in other Honda generator engines.

TABLE 5

Intake Valve Deposits in Various Engines Using Monobutoxylated Compounds

| Compound Example # | Engine | Fuel | Conc. ppm By Weight | Avg. Deposit Weight (mg) |
|---|---|---|---|---|
| 17 | 2.3 L FORD | 2DCP | 200 | 83.0 |
| -- | " | " | 0 | 154.0 |
| 17 | 2.3 L FORD | 2DBR | 200 | 261.0 |
| -- | " | " | 0 | 337.0 |
| 21 | 2.3 L FORD | 2DCP | 200 | 157.0 |
| -- | " | " | 0 | 154.0 |
| 25 | 2.3 L FORD | 2DCP | 200 | 150.0 |
| -- | " | " | 0 | 154.0 |
| 18 | 3.0 L FORD | 3DDP | 200 | 34.3 |
| -- | " | * | 0 | 246.6 |
| 18 | 3.3 L DODGE | 3DDP | 200 | 251.8 |
| -- | " | ** | 0 | 250.0 |

--Indicates the results achieved with base fuel in the absence of any additive compound (0 ppm additive compound).
*One run of similar premium unleaded base fuel in the same engine (3.0 L Ford).
**Indicates that this was an average of 3 similar premium unleaded base fuels in the same engine (3.3 L Dodge).

TABLE 6

Intake Valve Deposits in Various Engines Using Dibutoxylated Compounds

| Compound Example A | Engine | Fuel | Conc. ppm By Weight | Average Deposit Weight (mg) |
|---|---|---|---|---|
| 1 | 2.3 L FORD | 1DIP | 200 | 110.0 |
| -- | " | " | 0 | 298.0 |
| 1 | 2.3 L FORD | 1DFR | 200 | 251.0 |
| -- | " | " | 0 | 492.0 |
| 1 | 2.3 L FORD | 2DBR | 165 | 234.0 |
| -- | " | " | 0 | 337.0 |
| 1 | 3.0 L FORD | 2DCP | 200 | 27.0 |
| -- | " | * | 0 | 246.6 |
| 1 | 2.3 L OLDS | 1DIP | 200 | 101.0 |
| -- | " | " | 0 | 174.0 |
| 1 | 2.8 L CHEV | 1DIP | 200 | 85.0 |
| -- | " | " | 0 | 232.0 |
| 1 | 2.8 L CHEV | 1DFR | 200 | 204.0 |
| -- | " | " | 0 | 186.0 |
| 1 | 3.3 L DODGE | 1DIP | 200 | 132.0 |
| -- | " | " | 0 | 188.0 |
| 2 | 3.1 L CHEV | 1DFR | 200 | 254.2 |
| -- | " | " | 0 | 143.2 |
| 6 | 2.3 L FORD | 1DFR | 200 | 195.6 |
| -- | " | " | 0 | 492.0 |
| 6 | 3.3 L DODGE | 1DIP | 200 | 281.0 |
| -- | " | " | 0 | 188.0 |

TABLE 6-continued

Intake Valve Deposits in Various Engines Using Dibutoxylated Compounds

| Compound Example A | Engine | Fuel | Conc. ppm By Weight | Average Deposit Weight (mg) |
|---|---|---|---|---|
| 15 | 3.0 L FORD | 2DBR | 200 | 283.0 |
| -- | " | " | 0 | 360.0 |
| 15 | 2.3 L OLDS | 2DAP | 200 | 53.0 |
| -- | " | " | 0 | 92.0 |
| 15 | 3.3 L DODGE | 2DAP | 200 | 421.0 |
| -- | " | " | 0 | 211.0 |
| 9 | 2.3 L FORD | 2DAP | 200 | 74.0 |
| -- | " | " | 0 | 196.0 |
| 9 | 3.0 L FORD | 2DBR | 200 | 222.0 |
| -- | " | " | 0 | 360.0 |
| 9 | 2.7 L BMW | 2DAP | 200 | 98.0 |
| -- | " | " | 0 | 95.3 |
| 20 | 2.7 L BMW | 2DAP | 200 | 132.0 |
| -- | " | " | 0 | 95.3 |
| 23 | 2.3 L FORD | 2DCP | 200 | 121.0 |
| -- | " | " | 0 | 154.0 |
| 22 | 2.3 L FORD | 2DCP | 200 | 121.0 |
| -- | " | " | 0 | 154.0 |
| 24 | 2.3 L FORD | 2DCP | 200 | 184.0 |
| -- | " | " | 0 | 154.0 |
| 19 | 2.3 L OLDS | 2DCP | 200 | 113.0 |
| -- | " | " | 0 | 92.0 |

--Indicates the results achieved with base fuel in the absence of any additive compound (0 ppm additive compound).
*One run of similar premium unleaded base fuel in the same engine (3.0 L Ford).

TABLE 7

Intake Valve Deposits in Various Engines Using Tributoxylated Compounds

| Compound Example # | Engine | Fuel | Conc. ppm By Weight | Average Deposit Weight (mg) |
|---|---|---|---|---|
| 26 | 2.3 L FORD | 2DCP | 200 | 83 |
| -- | " | " | 0 | 154 |
| 27 | 2.3 L FORD | 2DCP | 200 | 82 |
| -- | " | " | 0 | 154 |
| 13 | 2.3 L FORD | 2DBR | 200 | 368 |
| -- | " | " | 0 | 337 |

--Indicates the results achieved with base fuel in the absence of any additive compound (0 ppm additive compound).

TABLE 8

Intake Valve Deposit Tests Utilizing Additional Detergents and Carrier Fluids

Additional intake valve deposit tests (as defined hereinbefore) were conducted in the 2.3 L Ford utilizing compounds as prepared in Example 1 and additional components (detergents or carrier fluids) in premium unleaded gasoline.

| Conc. ppm by Weight of Example 1 | Conc. ppm by Weight of Additional Component | Average Deposit Weight, mg |
|---|---|---|
| 150 | 150 ppm SAP-949[1] | 149 |
| -- | -- | 196 |

--Indicates the results achieved with base fuel in the absence of any additive compound (0 ppm additive compound).
[1]SAP-949-a polyoxypropylene glycol hemiether (monoether) commercially available from member companies of the Royal Dutch/Shell group.

Method For Octane Requirement Reduction and Octane Requirement Increase Control The purpose of octane requirement tests in engine dynamometer cells is to provide a method of determining the effect of various gasoline components and additives upon the octane requirement of the engine. Measurement of the effect of the induction system and combustion chamber deposits on octane requirement may also be performed.

Engines from vehicles are installed in dynamometer cells in such a way as to simulate road operation using a cycle of idle, low speed and high speed components while carefully controlling specific operating parameters. Two types of octane requirement test are conducted: octane requirement increase control and octane requirement reduction. Contribution of specific deposits to octane requirement may also be determined.

Prior to testing, each engine is inspected and has its induction system cleaned. Parts are checked for excessive wear and a new oil filter, fuel filter, intake valves and spark plugs are installed.

Octane requirement is measured initially with the clean engine, then at specific intervals, until a stable requirement is established. Test stand engines reach an octane stabilization in about 250 hours, or 9500 miles equivalent (168 hours per week). After stabilization, the engine is disassembled, cleaned, reassembled and the octane requirement measured again. This second clean engine octane requirement is referred to as "check back" since it checks back to the initial requirement. The check back octane requirement is the test reference, as it accommodates engine changes that occur throughout the test. A check back octane requirement significantly different from the initial requirement indicates a problem with the test. The difference between the check back octane requirement and the stable octane requirement is the octane requirement increase achieved during the test.

The entire process is repeated using the test gasoline. An octane requirement level established by the test gasoline less than the base gasoline represents octane requirement increase control favorable to the test gasoline.

Octane requirement reduction is a performance feature that demonstrates a reduction from the established octane requirement of a base gasoline in a given engine. The test need not start with a clean engine. The test protocol requires measurement of the octane requirement of an engine fueled with a base gasoline which generally consists of the test gasoline without additives or special treatment. However, the base gasoline may contain additives for a specific comparison. After reaching a stable octane requirement with the base gasoline, the engine is operated on test gasoline until the octane requirement again stabilizes. Rating intervals for test stands are typically twenty-four hours. Test stand engines may be used to conduct several octane requirement reduction tests in sequence with the engine being restabilized on base gasoline between each test. A stable reduction of octane requirement from that of the base gasoline represents octane requirement reduction favorable to the test gasoline.

TABLE 9

OCTANE REQUIREMENT INCREASE CONTROL TESTING

All tests were conducted using 200 ppm by weight non-volatile matter of Example 1.

| Test Engine | Fuel | Base Fuel Octane Requirement Minus Test Fuel Octane Requirement* |
|---|---|---|
| 3.1 L CHEV | PU | −2 |

*Positive numbers indicate good octane control performance.

TABLE 10

OCTANE REQUIREMENT REDUCTION TESTING

All tests were conducted using 200 ppm by weight non-volatile matter of the compound indicated.

| Compound Example # | Test Engine | Fuel | Base Fuel Octane Requirement Minus Test Fuel Octane Requirement* |
|---|---|---|---|
| 1 | 3.1 L CHEV | PU | 3 |

*Positive numbers indicate good octane requirement reduction performance.

What is claimed is:

1. A fuel composition comprising a mixture of a major amount of hydrocarbons in the gasoline boiling range and a minor amount of an additive compound having the formula:

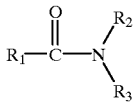

wherein $R_1$ is selected from the group consisting of hydrogen, hydrocarbyl of 1 to 100 carbon atoms and polyoxyalkylene alcohol of 2 to 200 carbon atoms; $R_2$ and $R_3$ are each independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms or $R_2$ and $R_3$ taken together form a heterocyclic group of 2 to 100 carbon atoms and the weight average molecular weight of the additive compound is at least about 600 with the proviso that at least one of $R_1$, $R_2$ or $R_3$ must be polyoxyalkylene alcohol.

2. The fuel composition of claim 1 wherein said additive compound is present in an amount from about 50 ppm by weight to about 400 ppm by weight based on the total weight of the fuel composition.

3. The fuel composition of claim 2 wherein the weight average molecular weight of the additive compound is from about 800 to about 4000.

4. The fuel composition of claim 3 wherein the polyoxyalkylene alcohol is of the formula wherein each $R_4$ is independently selected from the group consisting of hydrocarbyl of 2 to 100 carbon atoms and substituted hydrocarbyl of 2 to 100 carbon atoms and x is from 1 to 50.

5. The fuel composition of claim 4 wherein $R_3$ is polyoxyalkylene alcohol.

6. The fuel composition of claim 4 wherein $R_2$ and $R_3$ are polyoxyalkylene alcohol.

7. The fuel composition of claim 6 wherein $R_1$ is selected from the group consisting of hydrogen, and hydrocarbyl of 1 to 20 carbon atoms; each $R_4$ is independently selected from hydrocarbyl of 2 to 20 carbon atoms and substituted hydrocarbyl of 2 to 20 carbon atoms and each x is from 1 to 26.

8. The fuel composition of claim 7 wherein each $R_4$ is hydrocarbyl of the formula:

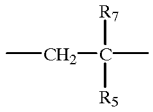

wherein each $R_7$ is independently selected from the group consisting of hydrogen, hydrocarbyl of 1 to 18 carbon atoms and substituted hydrocarbyl of 1 to 18 carbon atoms; each $R_5$ is independently selected from the group consisting of hydrogen, hydrocarbyl of 1 to 18 carbon atoms and substituted hydrocarbyl of 1 to 18 carbon atoms.

9. The fuel composition of claim 8 wherein each $R_7$ is hydrogen and each $R_5$ is independently selected from the group consisting of hydrogen, hydrocarbyl of 1 to 2 carbon atoms and oxy-substituted hydrocarbyl of the formula

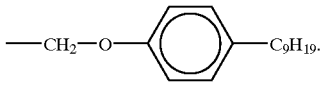

10. The fuel composition of claim 9 wherein $R_1$ and $R_2$ are each independently selected from alkyl of 1 to 20 carbon atoms.

11. The fuel composition of claim 9 wherein $R_4$ is hydrocarbyl of the formula:

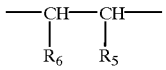

wherein each $R_6$ is independently selected from the group consisting of hydrogen, hydrocarbyl of 1 to 18 carbon atoms and substituted hydrocarbyl of 1 to 18 carbon atoms; and each $R_5$ is independently selected from the group consisting of hydrogen, hydrocarbyl of 1 to 18 carbon atoms and substituted hydrocarbyl of 1 to 18 carbon atoms.

12. The fuel composition of claim 4 wherein $R_1$, $R_2$ and $R_3$ are each polyoxyalkylene alcohol.

13. The fuel composition of claim 12 wherein each $R_4$ is independently selected from hydrocarbyl of 2 to 20 carbon atoms and substituted hydrocarbyl of 2 to 20 carbon atoms and each x is from 1 to 26.

14. The fuel composition of claim 13 wherein each $R_4$ is hydrocarbyl of the formula:

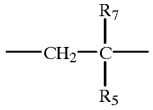

wherein each $R_7$ is independently selected from the group consisting of hydrogen, hydrocarbyl of 1 to 18 carbon atoms and substituted hydrocarbyl of 1 to 18 carbon atoms; each $R_5$ is independently selected from the group consisting of hydrogen, hydrocarbyl of 1 to 18 carbon atoms and substituted hydrocarbyl of 1 to 18 carbon atoms.

15. The fuel composition of claim 14 wherein each $R_7$ is independently selected from the group consisting of hydrogen and hydrocarbyl of 1 to 2 carbon atoms and each $R_5$ is independently selected from the group consisting of hydrogen and hydrocarbyl of 1 to 2 carbon atoms.

16. The fuel composition of claim 13 wherein $R_4$ is hydrocarbyl of the formula:

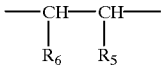

wherein each $R_6$ is independently selected from the group consisting of hydrogen, hydrocarbyl of 1 to 18 carbon atoms and each substituted hydrocarbyl of 1 to 18 carbon atoms and $R_5$ is independently selected from the group consisting of hydrogen, hydrocarbyl of 1 to 18 carbon atoms or substituted hydrocarbyl of 1 to 18 carbon atoms.

17. The fuel composition of claim 5 wherein $R_1$ is polyoxyalkylene alcohol and $R_2$ is selected from the group consisting of hydrogen, hydrocarbyl of 1 to 20 carbon atoms and substituted hydrocarbyl of 1 to 20 carbon atoms and each x is from 1 to 26.

18. The fuel composition of claim 4 wherein $R_1$ is polyoxyalkylene alcohol and $R_2$ and $R_3$ are each independently selected from the group consisting of hydrocarbyl of 1 to 20 carbon atoms and substituted hydrocarbyl of 1 to 20 carbon atoms or $R_2$ and $R_3$ together with the nitrogen atom to which they are connected form a heterocycle group of 4 to 20 carbon atoms.

19. The fuel composition of claim 18 wherein $R_2$ and $R_3$ are each independently selected from the group consisting of alkyl of 1 to 20 carbon atoms and cycloalkyl of 1 to 20 carbon atoms.

20. The fuel composition of claim 5 wherein $R_1$ is selected from the group consisting of hydrogen and hydrocarbyl of 1 to 20 carbon atoms and $R_2$ is selected from the group consisting of hydrogen, hydrocarbyl of 1 to 20 carbon atoms and substituted hydrocarbyl of 1 to 20 carbon atoms and each $R_4$ is independently selected from the group consisting of hydrocarbyl of 2 to 50 carbon atoms and substituted hydrocarbyl of 2 to 50 carbon atoms.

21. The fuel composition of claim 20 wherein $R_4$ is hydrocarbyl of the formula:

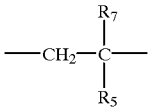

wherein each $R_7$ is independently selected from the group consisting of hydrogen, hydrocarbyl of 1 to 18 carbon atoms and substituted hydrocarbyl of 1 to 18 carbon atoms; and each $R_5$ is independently selected from the group consisting of hydrogen, hydrocarbyl of 1 to 18 carbon atoms and substituted hydrocarbyl of 1 to 18 carbon atoms.

22. The fuel composition of claim 21 wherein each $R_7$ is independently selected from the group consisting of hydrogen and hydrocarbyl of 1 to 2 carbon atoms and each $R_5$ is independently selected from the group consisting of hydrogen and hydrocarbyl of 1 to 2 carbon atoms.

23. The fuel composition of claim 22 wherein $R_1$ is selected from the group consisting of hydrogen and alkyl comprising 1 to 20 carbon atoms and $R_2$ is selected from the group consisting of hydrogen, alkyl of 1 to 20 carbon atoms and substituted hydrocarbyl of 1 to 20 carbon atoms.

24. The fuel composition of claim 23 wherein $R_4$ is hydrocarbyl of the formula:

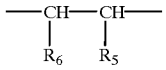

wherein each $R_6$ is independently selected from the group consisting of hydrocarbyl of 1 to 18 carbon atoms or substituted hydrocarbyl of 1 to 18 carbon atoms; and each $R_5$ is independently selected from the group consisting of hydrogen, hydrocarbyl of 1 to 18 carbon atoms or substituted hydrocarbyl of 1 to 18 carbon atoms; and x is from 18 to 24.

25. A method for decreasing intake valve deposits in an internal combustion engine which comprises burning in said engine a fuel composition comprising a major amount of hydrocarbons in the gasoline boiling range and a minor amount of an additive compound having the formula:

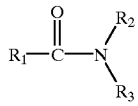

wherein $R_1$ is selected from the group consisting of hydrogen, hydrocarbyl of 1 to 100 carbon atoms and polyoxyalkylene alcohol of 2 to 200 carbon atoms; $R_2$ and $R_3$ are each independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms or $R_2$ and $R_3$ taken together form a heterocyclic group of 2 to 100 carbon atoms and the weight average molecular weight of the additive compound is at least about 600 with the proviso that at least one of $R_1$, $R_2$ or $R_3$ must be polyoxyalkylene alcohol.

26. The method of claim 25 wherein said additive compound is present in an amount from about 50 ppm by weight to about 400 ppm by weight based on the total weight of the fuel composition.

27. The method of claim 23 wherein the weight average molecular weight of the additive compound is from about 800 to about 4000.

28. The method of claim 27 wherein the polyoxyalkylene alcohol is of the formula

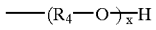

wherein each $R_4$ is independently selected from the group consisting of hydrocarbyl of 2 to 100 carbon atoms and substituted hydrocarbyl of 2 to 100 carbon atoms and x is from 1 to 50.

29. The method of claim 28 wherein $R_3$ is polyoxyalkylene alcohol.

30. The method of claim 28 wherein $R_1$ is polyoxyalkylene alcohol and $R_2$ and $R_3$ are each independently selected from the group consisting of hydrocarbyl of 1 to 20 carbon atoms and substituted hydrocarbyl of 1 to 20 carbon atoms or $R_2$ and $R_3$ together with the nitrogen atom to which they are connected form a heterocycle group of 4 to 20 carbon atoms.

31. The method of claim 30 wherein $R_2$ and $R_3$ are each independently selected from the group consisting of alkyl of 1 to 20 carbon atoms and cycloalkyl of 1 to 20 carbon atoms.

32. The method of claim 28 wherein $R_4$ is hydrocarbyl of the formula:

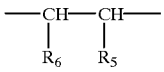

wherein each $R_6$ is independently selected from the group consisting of hydrogen, hydrocarbyl of 1 to 18 carbon atoms or substituted hydrocarbyl of 1 to 18 carbon atoms and each; $R_5$ is independently selected from the group consisting of hydrogen, hydrocarbyl of 1 to 18 carbon atoms or substituted hydrocarbyl of 1 to 18 carbon atoms.

33. The method of claim 29 wherein $R_2$ and $R_3$ are polyoxyalkylene alcohol.

34. The method of claim 33 wherein $R_1$ is selected from the group consisting of hydrogen and hydrocarbyl of 1 to 20 carbon atoms and each $R_4$ is independently selected from hydrocarbyl of 1 to 20 carbon atoms and substituted hydrocarbyl of 1 to 20 carbon atoms and each x is from 1 to 26.

35. The method of claim 34 wherein each $R_4$ is hydrocarbyl of the formula:

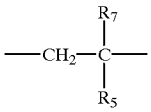

wherein each $R_7$ is independently selected from the group consisting of hydrogen, hydrocarbyl of 1 to 18 carbon atoms and substituted hydrocarbyl of 1 to 18 carbon atoms; each $R_5$ is independently selected from the group consisting of hydrogen, hydrocarbyl of 1 to 18 carbon atoms and substituted hydrocarbyl of 1 to 18 carbon atoms.

36. The method of claim 35 wherein each $R_7$ is hydrogen and each $R_5$ is independently selected from the group consisting of hydrogen, hydrocarbyl of 1 to 2 carbon atoms and oxy-substituted hydrocarbyl of the formula

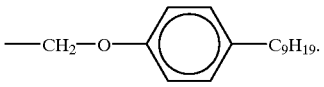

37. The method of claim 36 wherein $R_1$ and $R_2$ are each independently selected from alkyl of 1 to 20 carbon atoms.

38. The method of claim 35 wherein $R_4$ is hydrocarbyl of the formula:

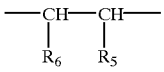

wherein each $R_6$ is independently selected from the group consisting of hydrogen, hydrocarbyl of 1 to 18 carbon atoms and substituted hydrocarbyl of 1 to 18 carbon atoms; and each $R_5$ is independently selected from the group consisting of hydrogen, hydrocarbyl of 1 to 18 carbon atoms and substituted hydrocarbyl of 1 to 18 carbon atoms.

39. The method of claim 29 wherein $R_1$ is polyoxyalkylene alcohol and $R_2$ is selected from the group consisting of hydrogen, hydrocarbyl of 1 to 20 carbon atoms and substituted hydrocarbyl of 1 to 20 carbon atoms and each x is from 1 to 26.

40. The method of claim 29 wherein $R_1$ is selected from the group consisting of hydrogen and hydrocarbyl of 1 to 20 carbon atoms and $R_2$ is selected from the group consisting of hydrogen, hydrocarbyl of 1 to 20 carbon atoms and substituted hydrocarbyl of 1 to 20 carbon atoms and each $R_4$ is independently selected from the group consisting of hydrocarbyl of 2 to 50 carbon atoms and substituted hydrocarbyl of 2 to 50 carbon atoms.

41. The method of claim 40 wherein $R_4$ is hydrocarbyl of the formula:

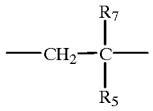

wherein each $R_7$ is independently selected from the group consisting of hydrogen, hydrocarbyl of 1 to 18 carbon atoms and substituted hydrocarbyl of 1 to 18 carbon atoms; and each $R_5$ is independently selected from the group consisting of hydrogen, hydrocarbyl of 1 to 18 carbon atoms and substituted hydrocarbyl of 1 to 18 carbon atoms.

42. The method of claim 41 wherein each $R_7$ is independently selected from the group consisting of hydrogen and hydrocarbyl of 1 to 2 carbon atoms and each $R_5$ is independently selected from the group consisting of hydrogen and hydrocarbyl of 1 to 2 carbon atoms.

43. The method of claim 42 wherein $R_1$ is selected from the group consisting of hydrogen and alkyl of 1 to 20 carbon atoms and $R_2$ is selected from the group consisting of hydrogen, alkyl of 1 to 20 carbon atoms and substituted hydrocarbyl of 1 to 20 carbon atoms.

44. The method of claim 28 wherein $R_1$, $R_2$ and $R_3$ are each polyoxyalkylene alcohol.

45. The method of claim 44 wherein each $R_4$ is independently selected from hydrocarbyl of 2 to 20 carbon atoms and substituted hydrocarbyl of 2 to 20 carbon atoms and each x is from 1 to 26.

46. The method of claim 45 wherein each $R_4$ is hydrocarbyl of the formula:

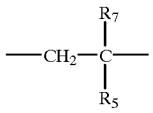

wherein each $R_7$ is independently selected from the group consisting of hydrogen, hydrocarbyl of 1 to 18 carbon atoms and substituted hydrocarbyl of 1 to 18 carbon atoms; each $R_5$ is independently selected from the group consisting of hydrogen, hydrocarbyl of 1 to 18 carbon atoms and substituted hydrocarbyl of 1 to 18 carbon atoms.

47. The method of claim 46 wherein each $R_7$ is independently selected from the group consisting of hydrogen and hydrocarbyl of 1 to 2 carbon atoms and each $R_5$ is independently selected from the group consisting of hydrogen and hydrocarbyl of 1 to 2 carbon atoms.

48. The method of claim 45 wherein $R_4$ is hydrocarbyl of the formula:

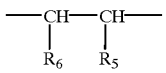

wherein each $R_6$ is independently selected from the group consisting of hydrogen, hydrocarbyl of 1 to 18 carbon atoms and each substituted hydrocarbyl of 1 to 18 carbon atoms and $R_5$ is independently selected from the group consisting of hydrogen, hydrocarbyl of 1 to 18 carbon atoms or substituted hydrocarbyl of 1 to 18 carbon atoms.

49. A compound of the formula:

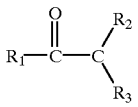

wherein $R_1$ is selected from the group consisting of hydrogen, alkyl of 1 to 20 carbon atoms and cycloalkyl of 4 to 20 carbon atoms, $R_2$ and $R_3$ are independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms with the proviso that at least one of $R_2$ or $R_3$ must be polyoxyalkylene alcohol, with further proviso that when $R_2$ or $R_3$ are polyoxyalkylene alcohol, they are polyoxyalkylene alcohol of the formula

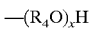

wherein each $R_4$ is independently selected from the group consisting of hydrocarbyl of 2 to 100 carbon atoms and substituted hydrocarbyl of 2 to 100 carbon atoms and x is from 1 to 50.

50. The compound of claim 49 wherein $R_3$ is polyoxyalkylene alcohol.

51. The compound of claim 50 wherein $R_2$ is selected from the group consisting of hydrogen, hydrocarbyl of 1 to 20 carbon atoms and substituted hydrocarbyl of 1 to 20 carbon atoms and each $R_4$ is independently selected from the group consisting of hydrocarbyl of 2 to 50 carbon atoms and substituted hydrocarbyl of 2 to 50 carbon atoms.

52. The compound of claim 51 wherein $R_4$ is hydrocarbyl of the formula:

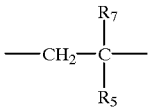

wherein each $R_7$ is independently selected from the group consisting of hydrogen, hydrocarbyl of 1 to 18 carbon atoms and substituted hydrocarbyl of 1 to 18 carbon atoms; and each $R_5$ is independently selected from the group consisting of hydrogen, hydrocarbyl of 1 to 18 carbon atoms and substituted hydrocarbyl of 1 to 18 carbon atoms.

53. The compound of claim 52 wherein each $R_7$ is independently selected from the group consisting of hydrogen and hydrocarbyl of 1 to 2 carbon atoms and each $R_5$ is independently selected from the group consisting of hydrogen and hydrocarbyl of 1 to 2 carbon atoms.

54. The compound of claim 53 wherein $R_2$ is selected from the group consisting of hydrogen, alkyl of 1 to 20 carbon atoms and substituted hydrocarbyl of 1 to 20 carbon atoms.

55. The compound of claim 49 wherein $R_2$ and $R_3$ are polyoxyalkylene alcohol.

56. The compound of claim 55 wherein each $R_4$ is independently selected from hydrocarbyl of 2 to 20 carbon atoms and substituted hydrocarbyl of 2 to 20 carbon atoms and each x is from 1 to 26.

57. The compound of claim 56 wherein each $R_4$ is hydrocarbyl of the formula:

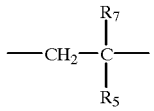

wherein each $R_7$ is independently selected from the group consisting of hydrogen, hydrocarbyl of 1 to 18 carbon atoms and substituted hydrocarbyl of 1 to 18 carbon atoms; each $R_5$ is independently selected from the group consisting of hydrogen, hydrocarbyl of 1 to 18 carbon atoms and substituted hydrocarbyl of 1 to 18 carbon atoms.

58. The compound of claim 57 wherein each $R_7$ is hydrogen and each $R_5$ is independently selected from the group consisting of hydrogen, hydrocarbyl of 1 to 2 carbon atoms and oxy-substituted hydrocarbyl of the formula

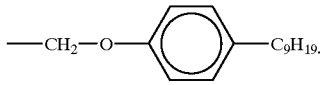

59. A fuel composition comprising a mixture of:

(a) a major amount of hydrocarbons in the gasoline boiling range;

(b) a minor amount of an additive compound having the general formula:

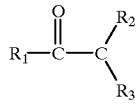

wherein $R_1$ is selected from the group consisting of hydrogen and hydrocarbyl of 1 to 100 carbon atoms; $R_2$ and $R_3$ are independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms wherein said polyoxyalkylene alcohol is of the formula

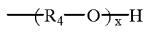

wherein each $R_4$ is selected from the group consisting of hydrocarbyl of 2 to 100 carbon atoms and substituted hydrocarbyl of 2 to 100 carbon atoms and x is from 1 to 50 with the provision that at least one of $R_2$ or $R_3$ must be polyoxyalkylene alcohol of 2 to 200 carbon atoms and the weight average molecular weight of the additive compound is at least about 600; and (c) a minor amount of a detergent selected from the group consisting of polyalkylenyl amines, Mannich amines, polyalkenyl succinimides, poly(oxyalkylene) carbamates, poly(alkenyl)-N-substituted carbamates and mixtures thereof.

60. A method for reducing octane requirement in an internal combustion engine which comprises burning in said engine a fuel composition comprising a major amount of hydrocarbons in the gasoline boiling range and a minor amount of an additive compound having the formula:

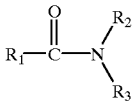

wherein $R_1$ is selected from the group consisting of hydrogen, hydrocarbyl of 1 to 100 carbon atoms and polyoxyalkylene alcohol of 2 to 200 carbon atoms; $R_2$ and $R_3$ are each independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms or $R_2$ and $R_3$ taken together form a heterocyclic group of 2 to 100 carbon atoms and the weight average molecular weight of the additive compound is at least about 600 with the proviso that at least one of $R_1$, $R_2$ or $R_3$ must be polyoxyalkylene alcohol.

61. The method of claim 60 wherein said additive compound is present in an amount from about 50 ppm by weight to about 400 ppm by weight based on the total weight of the fuel composition.

62. The method of claim 61 wherein the weight average molecular weight of the additive compound is from about 800 to about 4000.

63. The method of claim 62 wherein the polyoxyalkylene alcohol is of the formula

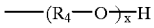

wherein each $R_4$ is independently selected from the group consisting of hydrocarbyl of 2 to 100 carbon atoms and substituted hydrocarbyl of 2 to 100 carbon atoms and x is from 1 to 50.

64. The method of claim 63 wherein $R_3$ is polyoxyalkylene alcohol.

65. The method of claim 64 wherein $R_1$ is selected from the group consisting of hydrogen and hydrocarbyl of 1 to 20 carbon atoms and $R_2$ is selected from the group consisting of hydrogen, hydrocarbyl of 1 to 20 carbon atoms and substituted hydrocarbyl of 1 to 20 carbon atoms and each $R_4$ is independently selected from the group consisting of hydrocarbyl of 2 to 50 carbon atoms and substituted hydrocarbyl of 2 to 50 carbon atoms.

66. The method of claim 65 wherein $R_4$ is hydrocarbyl of the formula:

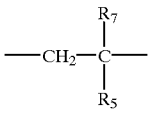

wherein each $R_7$ is independently selected from the group consisting of hydrogen, hydrocarbyl of 1 to 18 carbon atoms and substituted hydrocarbyl of 1 to 18 carbon atoms; and each $R_5$ is independently selected from the group consisting of hydrogen, hydrocarbyl of 1 to 18 carbon atoms and substituted hydrocarbyl of 1 to 18 carbon atoms.

67. The method of claim 66 wherein each $R_7$ is independently selected from the group consisting of hydrogen and hydrocarbyl of 1 to 2 carbon atoms and each $R_5$ is independently selected from the group consisting of hydrogen and hydrocarbyl of 1 to 2 carbon atoms.

68. The method of claim 67 wherein $R_1$ is selected from the group consisting of hydrogen and alkyl of 1 to 20 carbon atoms and $R_2$ is selected from the group consisting of hydrogen, alkyl of 1 to 20 carbon atoms and substituted hydrocarbyl of 1 to 20 carbon atoms.

69. The method of claim 65 wherein $R_4$ is hydrocarbyl of the formula:

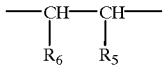

wherein each $R_6$ is independently selected from the group consisting of hydrogen, hydrocarbyl of 1 to 18 carbon atoms or substituted hydrocarbyl of 1 to 18 carbon atoms; and each $R_5$ is independently selected from the group consisting of hydrogen, hydrocarbyl of 1 to 18 carbon atoms or substituted hydrocarbyl of 1 to 18 carbon atoms.

70. The method of claim 63 wherein $R_2$ and $R_3$ are polyoxyalkylene alcohol.

71. The method of claim 70 wherein $R_1$ is selected from the group consisting of hydrogen, and hydrocarbyl of 1 to 20 carbon atoms; each $R_4$ is independently selected from hydrocarbyl of 2 to 20 carbon atoms and substituted hydrocarbyl of 2 to 20 carbon atoms and each x is from 1 to 26.

72. The method of claim 71 wherein each $R_4$ is hydrocarbyl of the formula:

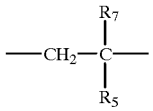

wherein each $R_7$ is independently selected from the group consisting of hydrogen, hydrocarbyl of 1 to 18 carbon atoms and substituted hydrocarbyl of 1 to 18 carbon atoms; each $R_5$ is independently selected from the group consisting of hydrogen, hydrocarbyl of 1 to 18 carbon atoms and substituted hydrocarbyl of 1 to 18 carbon atoms.

73. The method of claim 72 wherein each $R_7$ is hydrogen and each $R_5$ is independently selected from the group consisting of hydrogen, hydrocarbyl of 1 to 2 carbon atoms and oxy-substituted hydrocarbyl of the formula

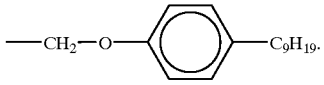

74. The method of claim 71 wherein $R_4$ is hydrocarbyl of the formula:

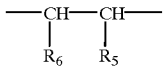

wherein each $R_6$ is independently selected from the group consisting of hydrogen, hydrocarbyl of 1 to 18 carbon atoms and substituted hydrocarbyl of 1 to 18 carbon atoms; and each $R_5$ is independently selected from the group consisting of hydrogen, hydrocarbyl of 1 to 18 carbon atoms and substituted hydrocarbyl of 1 to 18 carbon atoms.

75. The method of claim 63 wherein $R_1$, $R_2$ and $R_3$ are each polyoxyalkylene alcohol.

76. The method of claim 75 wherein each $R_4$ is independently selected from hydrocarbyl of 2 to 20 carbon atoms and substituted hydrocarbyl of 2 to 20 carbon atoms and each x is from 1 to 26.

77. The method of claim 76 wherein each $R_4$ is hydrocarbyl of the formula:

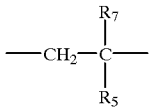

wherein each $R_7$ is independently selected from the group consisting of hydrogen, hydrocarbyl of 1 to 18 carbon atoms and substituted hydrocarbyl of 1 to 18 carbon atoms; each $R_5$ is independently selected from the group consisting of hydrogen, hydrocarbyl of 1 to 18 carbon atoms and substituted hydrocarbyl of 1 to 18 carbon atoms.

78. The method of claim 77 wherein each $R_7$ is independently selected from the group consisting of hydrogen and hydrocarbyl of 1 to 2 carbon atoms and each $R_5$ is independently selected from the group consisting of hydrogen and hydrocarbyl of 1 to 2 carbon atoms.

79. The method of claim 76 wherein $R_4$ is hydrocarbyl of the formula:

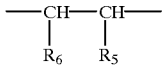

wherein each $R_6$ is independently selected from the group consisting of hydrogen, hydrocarbyl of 1 to 18 carbon atoms and substituted hydrocarbyl of 1 to 18 carbon atoms and each and $R_5$ is independently selected from the group consisting of hydrogen, hydrocarbyl of 1 to 18 carbon atoms or substituted hydrocarbyl of 1 to 18 carbon atoms.

80. The method of claim 60 wherein said additive compound is present in an amount from about 50 ppm by weight to about 400 ppm by weight based on the total weight of the fuel composition and the weight average molecular weight of the additive compound is from about 800 to about 4000.

81. The method of claim 80 wherein the polyoxyalkylene is of the formula

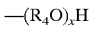

wherein each $R_4$ is independently selected from the group consisting of hydrocarbyl of 2 to 100 carbon atoms and substituted hydrocarbyl of 2 to 100 carbon atoms and x is from 1 to 50.

82. The method of claim 81 wherein $R_3$ is polyoxyalkylene alcohol and $R_1$ is selected from the group consisting of hydrogen and hydrocarbyl of 1 to 20 carbon atoms and $R_2$ is selected from the group consisting of hydrogen, hydrocarbyl of 1 to 20 carbon atoms and substituted hydrocarbyl of 1 to 20 carbon atoms and each $R_4$ is independently selected from the group consisting of hydrocarbyl of 2 to 50 carbon atoms and substituted hydrocarbyl of 2 to 50 carbon atoms.

83. The method of claim 82 wherein $R_4$ is hydrocarbyl of the formula:

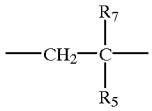

wherein each $R_7$ is independently selected from the group consisting of hydrogen, hydrocarbyl of 1 to 18 carbon atoms and substituted hydrocarbyl of 1 to 18 carbon atoms; and each $R_5$ is independently selected from the group consisting of hydrogen, hydrocarbyl of 1 to 18 carbon atoms and substituted hydrocarbyl of 1 to 18 carbon atoms.

84. The method of claim 83 wherein each $R_7$ is independently selected from the group consisting of hydrogen and hydrocarbyl of 1 to 2 carbon atoms and each $R_5$ is independently selected from the group consisting of hydrogen and hydrocarbyl of 1 to 2 carbon atoms and $R_1$ and $R_2$ are each independently selected from the group consisting of hydrogen, alkyl of 1 to 20 carbon atoms and substituted hydrocarbyl of 1 to 20 carbon atoms.

85. The method of claim 81 wherein $R_2$ and $R_3$ are polyoxyalkylene alcohol and $R_1$ is selected from the group consisting of hydrogen, and hydrocarbyl of 1 to 20 carbon atoms and each x is from 1 to 26.

86. The method of claim 85 wherein each $R_4$ is hydrocarbyl of the formula:

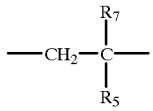

wherein each $R_7$ is independently selected from the group consisting of hydrogen, hydrocarby of 1 to 18 carbon atoms and substituted hydrocarbyl of 1 to 18 carbon atoms; and each $R_5$ is independently selected from the group consisting of hydrogen, hydrocarbyl of 1 to 18 carbon atoms and substituted hydrocarbyl of 1 to 18 carbon atoms.

87. The method of claim 86 wherein each $R_7$ is hydrogen and each $R_5$ is independently selected from the group consisting of hydrogen, hydrocarbyl of 1 to 2 carbon atoms and oxy-substituted hydrocarbyl of the formula:

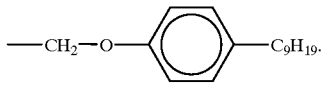

88. The method of claim 81 wherein $R_1$, $R_2$ and $R_3$ are each polyoxyalkylene alcohol and each $R_4$ is independently selected from hydrocarbyl of 2 to 20 carbon atoms and substituted hydrocarbyl of 2 to 20 carbon atoms and each x is from 1 to 26.

89. The method of claim 88 wherein each $R_4$ is hydrocarbyl of the formula:

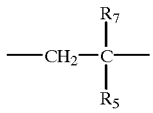

wherein each $R_7$ is independently selected from the group consisting of hydrogen, hydrocarbyl of 1 to 18 carbon atoms and substituted hydrocarbyl of 1 to 18 carbon atoms; and each $R_5$ is independently selected from the group consisting of hydrogen, hydrocarbyl of 1 to 18 carbon atoms and substituted hydrocarbyl of 1 to 18 carbon atoms.

90. The method of claim 89 wherein each $R_7$ is independently selected from the group consisting of hydrogen and hydrocarbyl of 1 to 2 carbon atoms and each $R_5$ is independently selected from the group consisting of hydrogen and hydrocarbyl of 1 to 2 carbon atoms.

91. The method of claim 82 wherein $R_1$ is polyoxyalkylene and $R_2$ is hydrogen, hydrocarbyl of 1 to 20 carbon atoms and substituted hydrocarbyl of 1 to 20 carbon atoms and each x is from 1 to 26.

92. The method of claim 81 wherein $R_1$ is polyoxyalkylene alcohol and $R_2$ and $R_3$ are each independently selected from the group consisting of hydrocarbyl of 1 to 20 carbon atoms and substituted hydrocarbyl of 1 to 20 carbon atoms or $R_2$ and $R_3$ together with the nitrogen atom to which they are connected form a heterocycle group of 4 to 20 carbon atoms.

93. The method of claim 92 wherein $R_2$ and $R_3$ are each independently selected from the group consisting of alkyl of 1 to 20 carbon atoms and cycloalkyl of 1 to 20 carbon atoms.

94. The method of claim 64 wherein $R_1$ is polyoxyalkylene and $R_2$ is hydrogen, hydrocarbyl of 1 to 20 carbon atoms and substituted hydrocarbyl of 1 to 20 carbon atoms and each x is from 1 to 26.

95. The method of claim 63 wherein $R_1$ is polyoxyalkylene alcohol and $R_2$ and $R_3$ are each independently selected from the group consisting of hydrocarbyl of 1 to 20 carbon atoms and substituted hydrocarbyl of 1 to 20 carbon atoms or $R_2$ and $R_3$ together with the nitrogen atom to which they are connected form a heterocycle group of 4 to 20 carbon atoms.

96. The method of claim 95 wherein $R_2$ and $R_3$ are each independently selected from the group consisting of alkyl of 1 to 20 carbon atoms and cycloalkyl of 1 to 20 carbon atoms.

97. A method for controlling octane requirement increase in an internal combustion engine which comprises burning in said engine a fuel composition comprising a major amount of hydrocarbons in the gasoline boiling range and a minor amount of an additive compound having the formula:

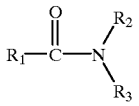

wherein $R_1$ is selected from the group consisting of hydrogen, hydrocarbyl of 1 to 100 carbon atoms and polyoxyalkylene alcohol of 2 to 200 carbon atoms; $R_2$ and $R_3$ are each independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms or $R_2$ and $R_3$ taken together form a heterocyclic group of 2 to 100 carbon atoms and the weight average molecular weight of the additive compound is at least about 600 with the proviso that at least one of $R_1$, $R_2$ or $R_3$ must be polyoxyalkylene alcohol.

98. A compound of the formula:

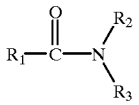

wherein $R_1$, $R_2$ and $R_3$ are each independently selected from polyoxyalkylene alcohol of 2 to 100 carbon atoms of the formula $$-(R_4O)_xH$$

wherein each $R_4$ is independently selected from the group consisting of hydrocarbyl of 2 to 100 carbon atoms and substituted hydrocarbyl of 2 to 100 carbon atoms and x is from 1 to 50.

99. The compound of claim 98 wherein each $R_4$ is independently selected from hydrocarbyl of 2 to 20 carbon atoms and substituted hydrocarbyl of 2 to 20 carbon atoms and each x is from 1 to 26.

100. The compound of claim 99 wherein each $R_4$ is hydrocarbyl of the formula:

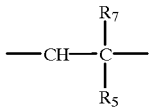

wherein each $R_7$ is independently selected from the group consisting of hydrogen, hydrocarbyl of 1 to 18 carbon atoms and substituted hydrocarbyl of 1 to 18 carbon atoms; each $R_5$ is independently selected from the group consisting of hydrogen, hydrocarbyl of 1 to 18 carbon atoms and substituted hydrocarbyl of 1 to 18 carbon atoms.

101. The compound of claim 100 wherein each $R_7$ is independently selected from the group consisting of hydrogen and hydrocarbyl of 1 to 2 carbon atoms and each $R_5$ is independently selected from the group consisting of hydrogen and hydrocarbyl of 1 to 2 carbon atoms.

102. A fuel composition comprising a mixture of a major amount of hydrocarbons in the gasoline boiling range and a minor amount of an additive compound having the formula:

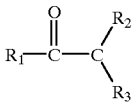

wherein $R_1$ is a substituted aliphatic hydrocarbyl of 1 to 100 carbon atoms; $R_2$ and $R_3$ are each independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms and the weight average molecular weight of the additive compound is at least about 600 with the proviso that at least one of $R_2$ or $R_3$ must be polyoxyalkylene alcohol.

103. The fuel composition of claim 102 wherein $R_1$ is oxy-substituted aliphatic hydrocarbyl of 1 to 50 carbon atoms.

104. The fuel composition of claim 102 wherein $R_1$ is a substituted aliphatic hydrocarbyl of 1 to 50 carbon atoms and $R_2$ is selected from the group consisting of hydrogen, hydrocarbyl of 1 to 20 carbon atoms and substituted hydrocarbyl of 1 to 20 carbon atoms.

105. A method for decreasing intake valve deposits in an internal combustion engine which comprises burning in said engine a fuel composition comprising a major amount of hydrocarbon in the gasoline boiling range and a minor amount of an additive compound having the formula:

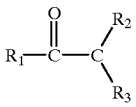

wherein $R_1$ is substituted aliphatic hydrocarbyl of 1 to 100 carbon atoms; $R_2$ and $R_3$ are each independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms and the weight average molecular weight of the additive compound is at least about 600 with the proviso that at least one of $R_2$ or $R_3$ must be polyoxyalkylene alcohol.

106. The method of claim 105 wherein $R_1$ is substituted aliphatic hydrocarbyl of 1 to 50 carbon atoms.

107. The method of claim 98 wherein $R_1$ is substituted aliphatic hydrocarbyl of 1 to 50 carbon atoms.

108. A method for controlling octane requirement increase in an internal combustion engine which comprises burning in said engine a fuel composition comprising a major amount of hydrocarbons in the gasoline boiling range and a minor amount of an additive compound having the formula:

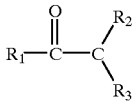

wherein $R_1$ is substituted aliphatic hydrocarbyl of 1 to 100 carbon atoms; $R_2$ and $R_3$ are each independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms and the weight average molecular weight of the additive compound is at least about 600 with the proviso that at least one of $R_2$ or $R_3$ must be polyoxyalkylene alcohol.

109. A method for reducing octane requirement in an internal combustion engine which comprises burning in said engine a fuel composition comprising a major amount of hydrocarbons in the gasoline boiling range and a minor amount of an additive compound having the formula:

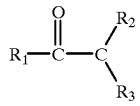

wherein $R_1$ is substituted aliphatic hydrocarbyl of 1 to 100 carbon atoms; $R_2$ and $R_3$ are each independently selected from the group consisting of hydrogen, hydrocarbyl of 1 to 100 carbon atoms, substituted hydrocarbyl of 1 to 100 carbon atoms and polyoxyalkylene alcohol of 2 to 200 carbon atoms and the weight average molecular weight of the additive compound is at least about 600 with the proviso that at least one of $R_2$ or $R_3$ must be polyoxyalkylene alcohol.

110. The method of claim 109 wherein $R_1$ is substituted aliphatic hydrocarbyl of 1 to 50 carbon atoms.

* * * * *